US010309143B2

(12) United States Patent
Eom et al.

(10) Patent No.: US 10,309,143 B2
(45) Date of Patent: Jun. 4, 2019

(54) REFRIGERATOR

(71) Applicant: Samsung Electronics Co., Ltd., Suwon-si, Gyeonggi-do (KR)

(72) Inventors: Tae-In Eom, Hwaseong-si (KR); Chan Young Park, Suwon-si (KR); Hyun Uk Park, Suwon-si (KR); Young Kyun Jeong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/942,833

(22) Filed: Apr. 2, 2018

(65) Prior Publication Data

US 2018/0334844 A1 Nov. 22, 2018

(30) Foreign Application Priority Data

May 17, 2017 (KR) ..... 10-2017-0061099

(51) Int. Cl.
*F25D 23/02* (2006.01)
*E05F 15/611* (2015.01)

(52) U.S. Cl.
CPC ..... *E05F 15/611* (2015.01); *F25D 23/028* (2013.01); *E05Y 2201/604* (2013.01); *E05Y 2900/31* (2013.01); *F25D 2323/024* (2013.01)

(58) Field of Classification Search
CPC ..... E05F 15/611; E05Y 2201/604; E05Y 2900/31; F25D 23/028
See application file for complete search history.

(56) References Cited

U.S. PATENT DOCUMENTS

2010/0043595 A1* 2/2010 Mattle ..... A47B 88/457 74/625
2011/0083461 A1* 4/2011 Kim ..... F25D 23/028 62/264
2017/0097185 A1* 4/2017 Yasaka ..... E05F 15/614
2017/0261252 A1* 9/2017 Son ..... F25D 23/028
2017/0284144 A1* 10/2017 Yasaka ..... E05F 15/614
2018/0223582 A1* 8/2018 Shin ..... F25D 23/028
2018/0283077 A1* 10/2018 Lee ..... E05F 15/70
2018/0291669 A1* 10/2018 Kim ..... E05F 15/619

FOREIGN PATENT DOCUMENTS

JP 2005-326044 11/2005
JP 2016-102608 6/2016
KR 10-1537377 7/2015
KR 10-1578354 12/2015
KR 10-2016-0029514 3/2016

OTHER PUBLICATIONS

Extended European Search Report dated Sep. 20, 2018 in European Patent Application No. 18166344.4.

* cited by examiner

*Primary Examiner* — Daniel J Rohrhoff
(74) *Attorney, Agent, or Firm* — Staas & Halsey LLP

(57) ABSTRACT

Disclosed herein is a refrigerator which includes a body, a door configured to open and close a storage compartment and a door opening and closing apparatus. The door opening and closing apparatus includes a pair of intermittent gears configured to transmit the power from a first gear to a second gear of the door opening and closing apparatus and configured to prevent an external force from being transmitted from the second gear to the first gear while the external force is applied to open and close the door. This configuration, among other benefits, improves the durability of a door opening and closing apparatus.

20 Claims, 27 Drawing Sheets

REFRIGERATOR

CROSS-REFERENCE TO RELATED APPLICATIONS

This application is based on and claims priority under 35 U.S.C. § 119 to Korean Patent Application No. 10-2017-0061099, filed on May 17, 2017, in the Korean Intellectual Property Office, the disclosure of which is incorporated by reference herein in its entirety.

BACKGROUND

1. Field

Embodiments of the present disclosure relate to a refrigerator having an improved door opening and closing structure.

2. Description of the Related Art

Generally, a refrigerator is an apparatus to keep food fresh by having a storage compartment for storing food and a cold supply device for supplying cold air to the storage compartment.

The refrigerator may be classified by a type of a storage compartment and a door.

Particularly, the refrigerator may be classified into Top Mounted Freezer (TMF) type refrigerator having a storage compartment divided into an upper side and a lower side by a horizontal partition and thus a freezing compartment is formed in the upper side and a refrigerating compartment is formed in the lower side, and Bottom Mounted Freezer (BMF) type refrigerator in which a refrigerating compartment is formed in the upper side and a freezing compartment is formed in the lower side.

In addition, the refrigerator may be classified into Side by Side (SBS) type refrigerator having a storage compartment divided into a left side and a right side by a vertical partition and thus a freezing compartment is formed in one side and a refrigerating compartment is formed in the other side, and French Door Refrigerator (FDR) type refrigerator having a storage compartment divided into an upper side and a lower side by a horizontal partition and thus a refrigerating compartment is formed in the upper side and a freezing compartment is formed in the lower side, wherein the refrigerating compartment is opened or closed by a pair of doors.

The door for opening and closing the storage compartment of the refrigerator may be configured to be opened and closed by a user manually. However, sometimes, a user cannot use his or her hands for opening or closing the door of the refrigerator since the user holds foods to put the foods or takes the foods out of the refrigerator. In this case, the user should put the foods to another place, and then the user can open or close the door of the refrigerator with his or her hands. To relieve the inconvenience, a structure capable of automatically opening or closing the door has been suggested.

SUMMARY

Therefore, it is an aspect of the present disclosure to provide a refrigerator having a structure capable of automatically opening and closing a door.

It is another aspect of the present disclosure to provide a refrigerator having an improved structure to improve the durability of a door opening and closing apparatus.

It is another aspect of the present disclosure to provide a refrigerator capable of reducing a load of a motor.

Additional aspects of the disclosure will be set forth in part in the description which follows and, in part, will be obvious from the description, or may be learned by practice of the disclosure.

In accordance with an aspect of the present invention, a refrigerator includes a body provided with a storage compartment; a door rotatable with respect to a hinge shaft on the body and configured to open and close the storage compartment; and a door opening and closing apparatus configured to open and close the door. The door opening and closing apparatus includes a motor configured to generate power; a first gear rotated in conjunction with the power generated by the motor; a second gear configured to transmit a rotational force to the hinge shaft as the door opens and closes; and a pair of intermittent gears configured to transmit the power from the first gear to the second gear and configured to prevent an external force from being transmitted from the second gear to the first gear while the external force is applied to open and close the door.

The pair of intermittent gears may include a first intermittent gear and a second intermittent gear rotated with respect to the same axis as the first intermittent gear. The first intermittent gear may be detachably coupled to the second intermittent gear in the axial direction.

The first intermittent gear may be moved between a coupling position in which the first intermittent gear is coupled to the second intermittent gear to transmit the power to the second intermittent gear, and a separated position in which the first intermittent gear is separated from the second intermittent gear.

A refrigerator may further include an intermittent gear elastic member configured to generate an elastic restoring force toward the axial direction to resiliently return the first intermittent gear from the separated position to the coupling position.

The second intermittent gear may be operated depending on the rotation of the second gear.

The first and second intermittent gears may include at least one first and second inclined boss portion formed on surfaces facing each other.

The first and second inclined boss portions may include first and second inclined surfaces configured to come into contact with each other to transmit the power from the first intermittent gear to the second intermittent gear, and the first inclined surface and the second inclined surface being formed to be inclined in a circumferential direction with respect to a direction in which the first and second intermittent gears face each other. The first and second inclined surfaces may be configured to generate a slip therebetween due to the external force.

The at least one first and second inclined boss portion may include a plurality of first and second inclined boss portions alternately disposed.

The refrigerator may further include a third gear engaged with the first gear; and a pair of idle gears moved in a circumferential direction by the rotation of the third gear so as to selectively transmit the rotational force of the third gear to the pair of intermittent gears.

The pair of idle gears may be moved between a first position in which a first idle gear of the pair of idle gears is engaged with the pair of intermittent gears while the third gear is rotated in a first direction; a second position in which a second idle gear of the pair of idle gears is engaged with the pair of intermittent gears while the third gear is rotated in a second direction opposite to the first direction; and a third position in which the first and second idle gears are separated from the pair of intermittent gears.

The refrigerator further may include a switching member provided with the pair of idle gears and configured to allow the pair of idle gears to be moved from the first position to the third position, in conjunction with the third gear.

In the first position, a forward rotational force of the motor may be transmitted to open the door, and in the second position, a reverse rotational force of the motor may be transmitted to close the door.

The refrigerator may further include a pressure device configured to press the body to open the door; and a mounting member provided with a pressing protrusion configured to transmit the power to the pressure device, and configured to be rotated together with the third gear such that the switching member may be disposed between the mounting member and the third gear. The switching member may be operated independently of the mounting member.

The pressure device may include a sliding member moved in a slide manner by being pressed by the pressing protrusion; and a pressing member configured to be rotated by the sliding movement of the sliding member and configured to come into contact with the body to open the door.

The pressure device may include a delay member configured to allow an operation of the pressure device and an operation in which the pair of idle gears is placed in the first position, to be sequentially performed.

In accordance with an aspect of the present invention, a refrigerator includes a body provided with a storage compartment; a door configured to be rotatable with respect to a hinge shaft disposed at the body and configured to open and close the storage compartment; and a door opening and closing apparatus configured to open and close the door. The door opening and closing apparatus includes a motor configured to generate power; a rotary gear restrained by the hinge shaft; and a driving gear configured to transmit the power generated from the motor to the rotary gear. The driving gear comprises a pair of intermittent gears configured to detach from each other, to prevent a load from being applied in a direction opposite to a rotation direction of the motor, or greater than a rotational force of the motor, to the rotary gear.

The pair of intermittent gears may include a first intermittent gear and a second intermittent gear rotated with respect to the same axis as the first intermittent gear. The first intermittent gear may be detachably coupled to the second intermittent gear in the axial direction.

The first intermittent gear may be moved between a coupling position in which the first intermittent gear is coupled to the second intermittent gear to transmit the power to the second intermittent gear, and a separated position in which the first intermittent gear is separated from the second intermittent gear.

The first and second intermittent gears may include at least one first and second inclined boss portion formed on surfaces facing each other.

In accordance with an aspect of the present invention, a refrigerator includes a body provided with a storage compartment; a door configured to open and close the storage compartment; and a door opening and closing apparatus configured to open and close the door. The door opening and closing apparatus includes a motor configured to generate power; a first gear rotated in conjunction with the power generated by the motor; a second gear configured to transmit a rotational force to the hinge shaft of the door as the door opens and closes; a third gear configured to engage with the first gear; and a pair of idle gears configured to selectively transmit the rotational force of the third gear to the second gear, through the rotation of the third gear. The second gear includes a pair of intermittent gears configured to be moved between a coupling position to transfer the power transmitted from the motor to the hinge shaft, and a separated position to prevent a load from the hinge shaft to the motor.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
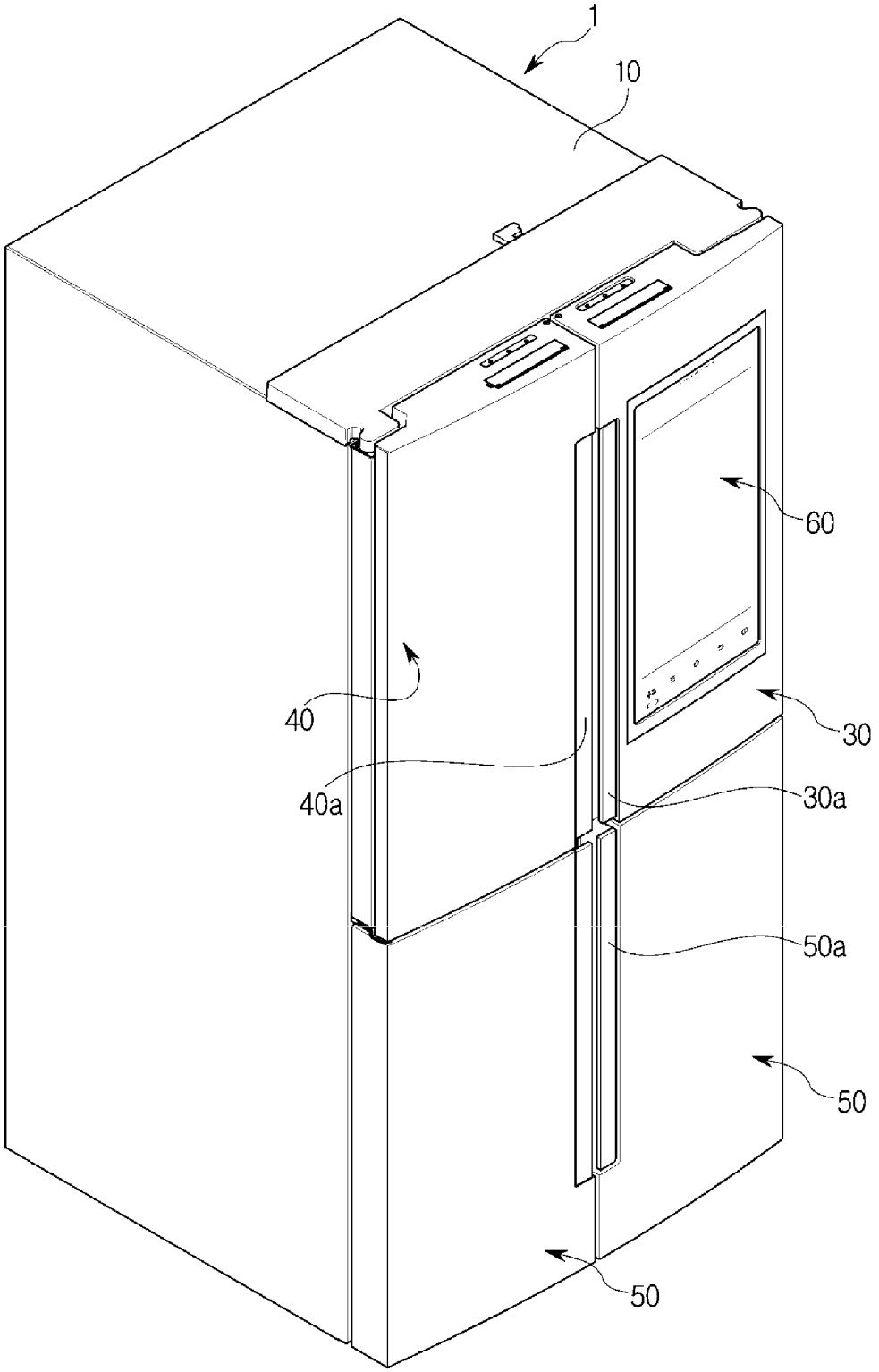
FIGS. 1 and 2 are perspective views of a refrigerator in accordance with an embodiment.

Embodiments described in the present disclosure and configurations shown in the drawings are merely examples of the embodiments of the present disclosure, and may be modified in various different ways at the time of filing of the present application to replace the embodiments and drawings of the present disclosure.

In addition, the same reference numerals or symbols shown in the drawings of the present disclosure indicate elements or components performing substantially the same function.

Also, the terms used herein are used to describe the embodiments and are not intended to limit and/or restrict the present disclosure. The singular forms "a," "an" and "the" are intended to include the plural forms as well, unless the context clearly indicates otherwise. In this present disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the present disclosure, a first element may be termed as a second element, and a second element may be termed as a first element. The term of "and/or" includes a plurality of combinations of relevant items or any one item among a plurality of relevant items.

The present disclosure will be described more fully hereinafter with reference to the accompanying drawings.

Figure 2:
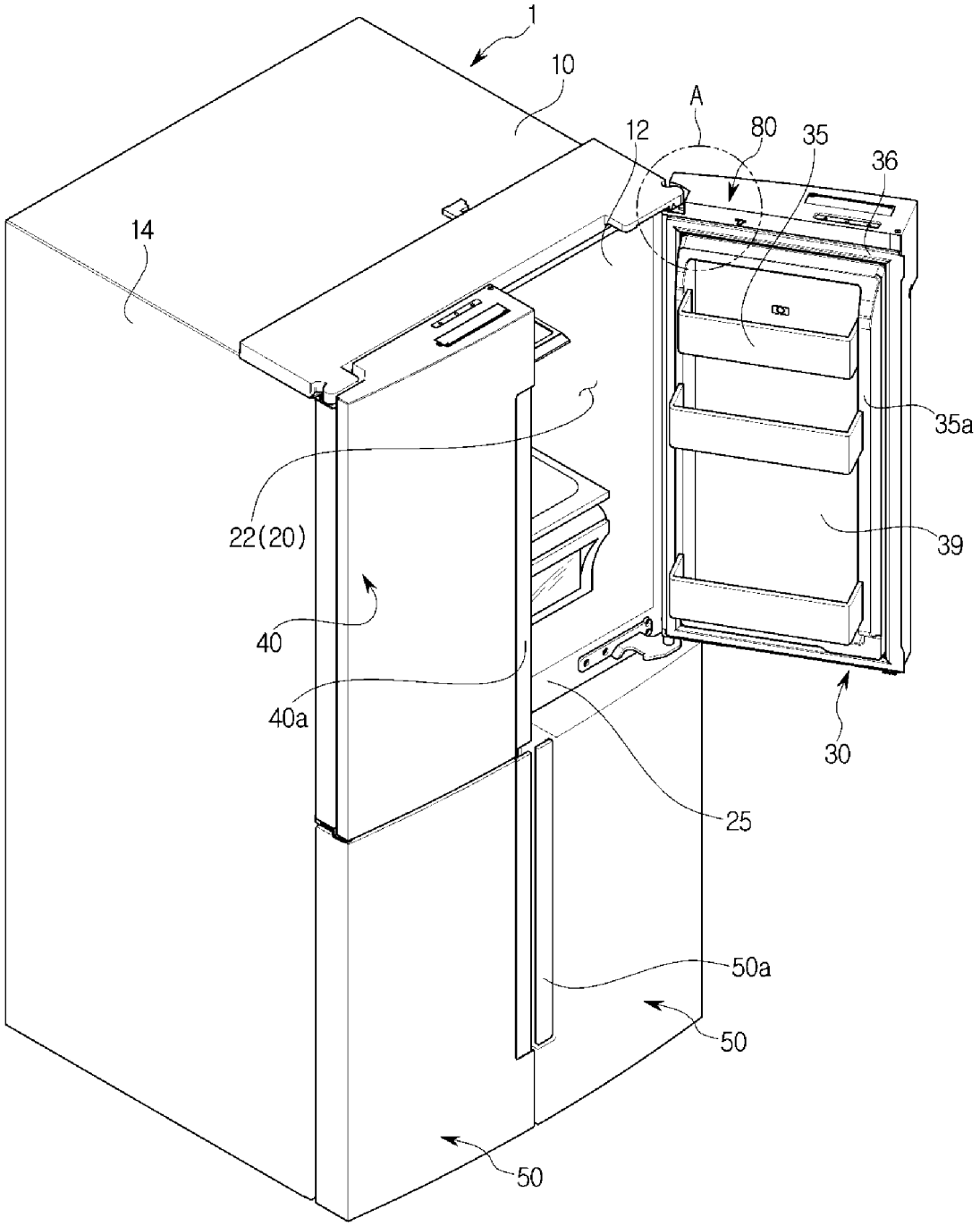

FIGS. 1 and 2 are perspective views of a refrigerator in accordance with an embodiment.

A refrigerator 1 may include a body 10, a storage compartment 20 formed in the body 10 to be divided into an upper portion and a lower portion, a door 30 configured to open and close the storage compartment 20, and a cold air supply device (not shown) configured to supply cold air to the storage compartment 20.

The body 10 may include an inner case 12 forming the storage compartment 20, an outer case 14 coupled to the outside of the inner case 12 to form an appearance, and an insulation material (not shown) foamed between the inner case 12 and the outer case 14 to insulate the storage compartment 20.

The cold air supply device may generate cold air using a cooling cycle that compresses, condenses, expands, and evaporates the refrigerant.

A front surface of the storage compartment 20 is configured to open, and the storage compartment 20 may be divided into a refrigerating compartment 22 disposed in the upper side and a freezing compartment (not shown) disposed in the lower side by a horizontal partition 25. The refrigerating compartment 22 may be opened and closed by a pair of door 30 and 40 rotatably coupled to the body 10. The freezing compartment may be opened and closed by a pair of door 50 rotatably coupled to the body 10. The shape of the doors 30, 40 and 50 is not limited thereto and thus a sliding door configured to open and close the storage compartment in a sliding manner may be employed.

The pair of door 30 and 40 opening and closing the refrigerating compartment 22 may be arranged on the left and right. Hereinafter for the convenience of the description, with respect to the drawings, a right side door 30 will be referred to as a first door 30, and a left side door 40 will be referred to as a second door 40. In the relationship between the doors 30 and 40 of the refrigerating compartment 22 and the door 50 of the freezing compartment, the doors 30 and 40 of the refrigerating compartment 22 may be referred to as upper doors 30 and 40 and the door 50 of the freezing compartment may be referred to as a lower door 50. The first door 30 may be provided with a first door handle 30*a* that can be grasped to open and close the first door 30 and the second door 40 may be provided with a second door handle 40*a* that can be grasped to open and close the second door 40. The lower door 50 may be also provided with a lower door handle 50*a* that can be grasped to open and close the lower door 50.

Figure 3:
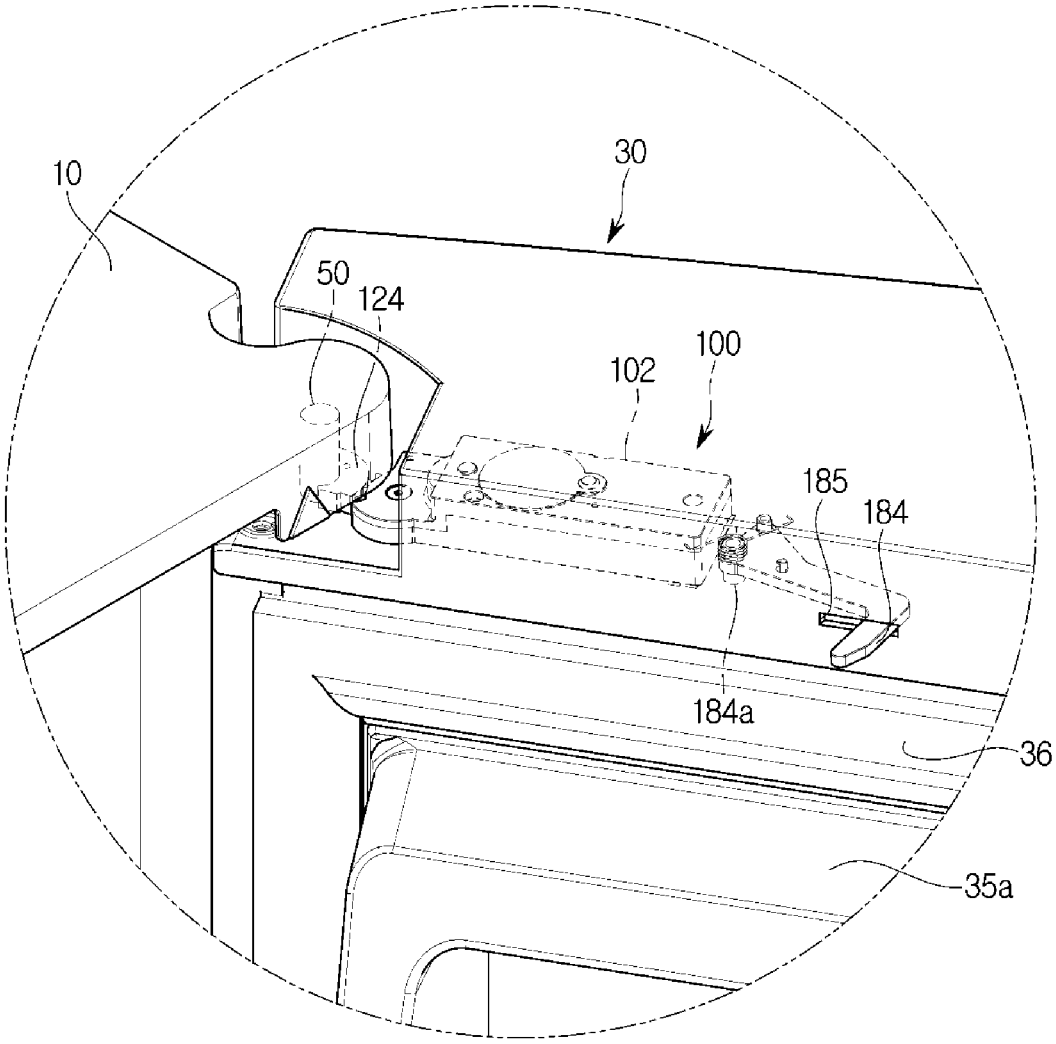
FIG. 3 is an enlarged view of A in FIG. 2.

The doors 30, 40 and 50 may be rotatable about the body 10 with respect to a hinge shaft 51 (refer to FIG. 3).

The first door 30 may open and close the right part of the refrigerating compartment 22 and the second door 40 may open and close the remaining part of the refrigerating compartment 22. A door shelf 35 configured to store foods may be provided on the rear surface of the first door 30 and the second door 40, respectively. As illustrated in FIG. 2, door shelf 35 may be provided on rear surface 39 of the first door 30.

The door shelf 35 may include a shelf support portion 35*a* extending vertically from the first and second doors 30 and 40 to support the door shelf 35 on both left and right sides of the door shelf 35. The shelf support portion 35*a* may be detachably provided in the doors 30, 40 and 50 as a separate configuration and according to an embodiment, the door shelf 35 may be extended from the doors 30, 40 and 50.

A gasket 36 configured to seal a gap with the body 10 when the first door 30 and the second door 40 are closed, may be provided on an edge portion of the rear surface of the first door 30 and the second door 40, respectively.

The gasket 36 may be installed along the edge portion of the rear surface of the first door 30 and the second door 40 in a loop shape, wherein a magnet (not shown) may be provided inside of the gasket 36.

A bar assembly (not shown) may be provided to seal a gap, wherein the gap is generated between the first door 30 and the second door 40 in a state in which the first door 30 and the second door 40 are closed.

The refrigerator 1 may include a display device 60 having an input/output function. The display device 60 may be installed on the front surface of the door 30 for the convenience of the user.

Figure 4:
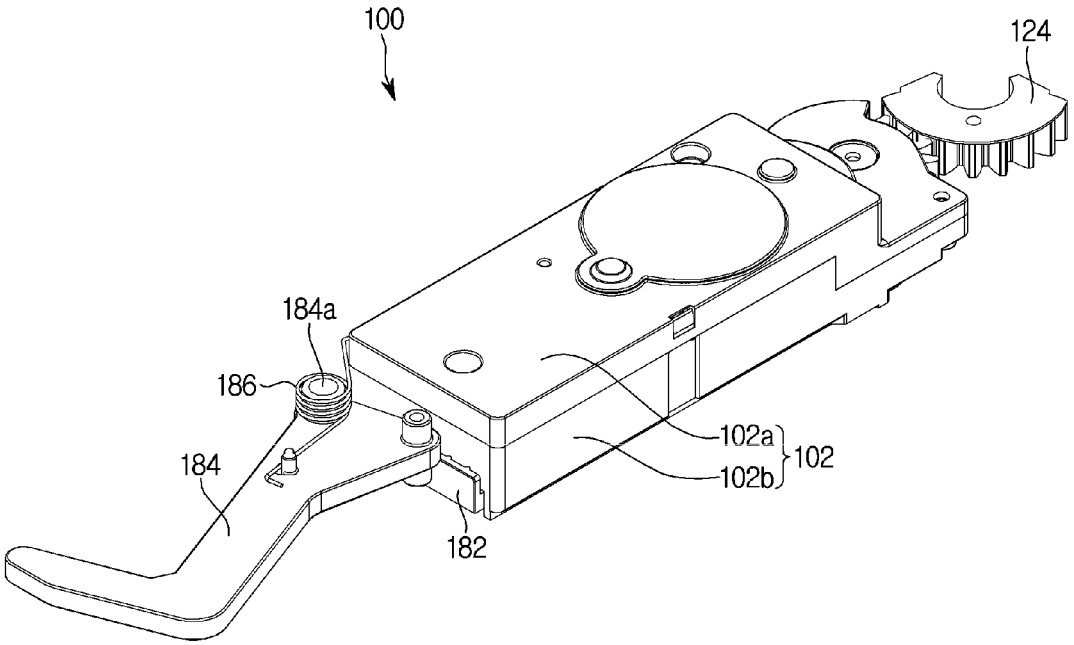
FIG. 4 is a perspective view of a door opening and closing apparatus of the refrigerator according to an embodiment.
Figure 5:
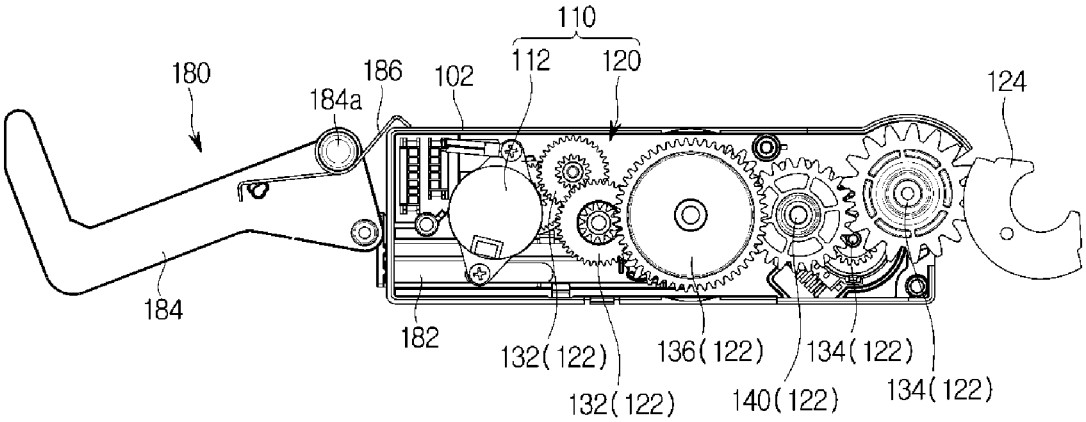
FIG. 5 is a view from above of the inside of the door opening and closing apparatus of the refrigerator according to an embodiment.
Figure 6:
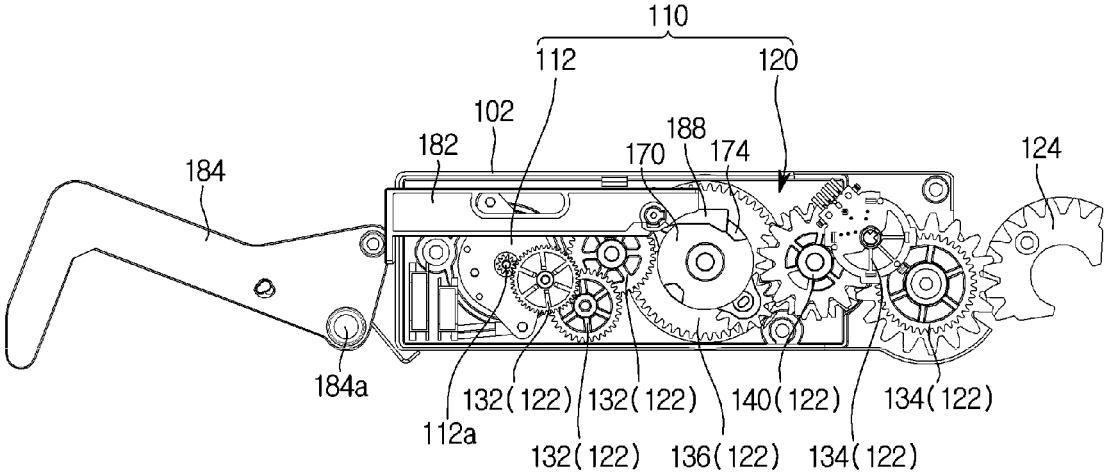
FIG. 6 is a view from below of the inside of the door opening and closing apparatus of the refrigerator according to an embodiment.
Figure 7:
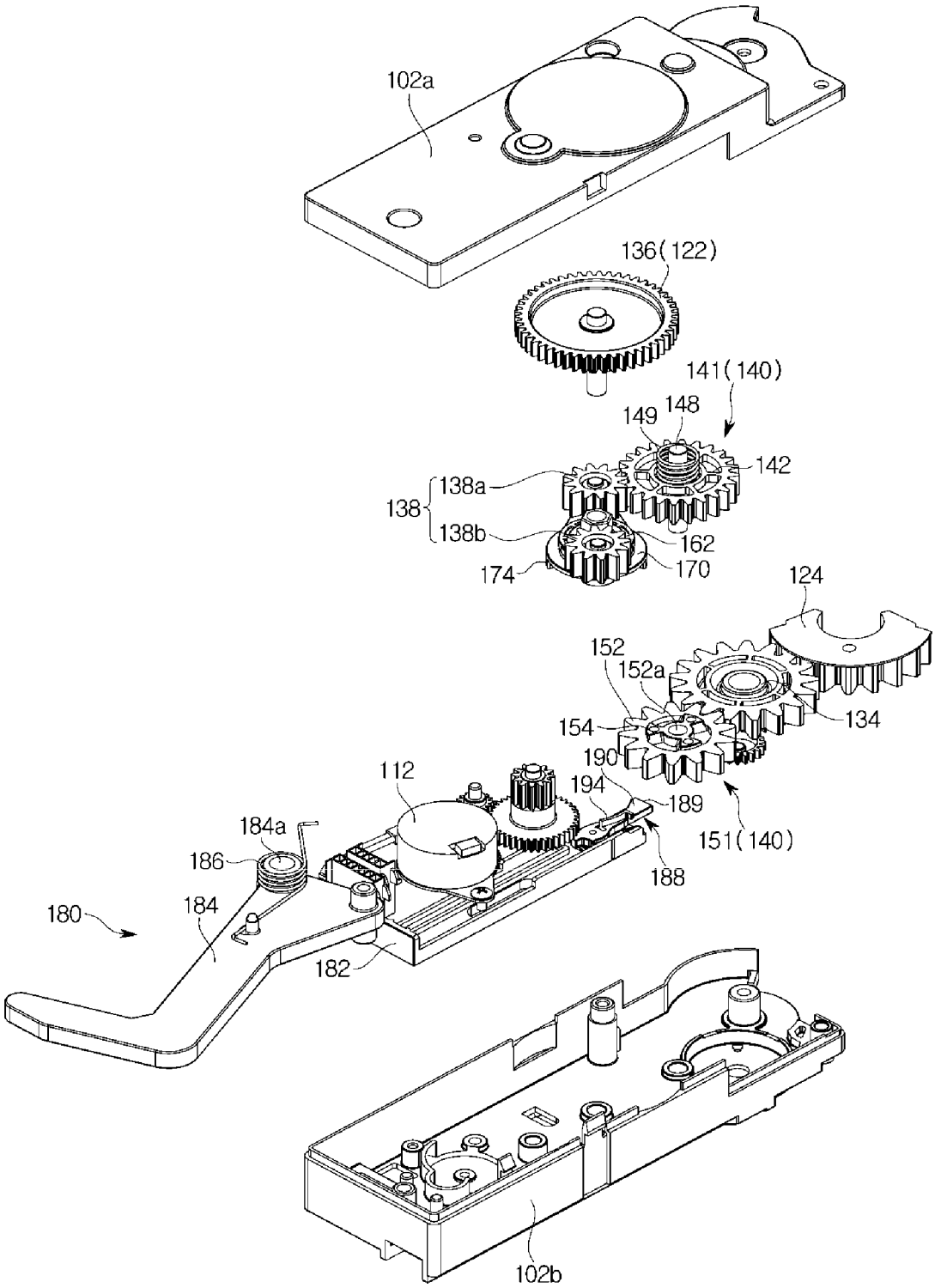
FIG. 7 is an exploded-perspective view of the door opening and closing apparatus of the refrigerator according to an embodiment.

FIG. 3 is an enlarged view of A in FIG. 2, FIG. 4 is a perspective view of a door opening and closing apparatus of the refrigerator according to an embodiment, FIG. 5 is a view from above of the inside of the door opening and closing apparatus of the refrigerator according to an embodiment, FIG. 6 is a view from below of the inside of the door opening and closing apparatus of the refrigerator according to an embodiment, and FIG. 7 is an exploded-perspective view of the door opening and closing apparatus of the refrigerator according to an embodiment.

The refrigerator 1 may include a door opening and closing apparatus 100.

The door opening and closing apparatus 100 may be configured to open and close the door 30 of the refrigerator 1. The door opening and closing apparatus 100 may be installed in each of the pair of upper doors 30 and 40, but is not limited thereto. The door opening and closing apparatus 100 may be installed on any one of the pair of upper doors 30 and 40, or on the lower door 50. For convenience of description, it is assumed that the door opening and closing apparatus 100 is disposed on the first door 30.

The door opening and closing apparatus 100 may include an apparatus body 102, a driving device 110 accommodated in the apparatus body 102, and a pressure device 180 separating the door 30 from the body.

The apparatus body 102 may be configured to accommodate the driving device 110 and the pressure device 180 therein. The apparatus body 102 may be disposed on the upper portion of the door 30. The apparatus body 102 may be installed such that the left and right direction of the door 30 is in the longitudinal direction. The apparatus body 102 may include a lower apparatus body 102*b* and an upper apparatus body 102*a* coupled to the lower apparatus body 102*b* such that a plurality of driving gears 122 and a rotary gear 124 are seated inside thereof.

The driving device 110 may generate power and transmit the power to the door 30 to open and close the door 30.

The driving device 110 may include a power generator and a power transmitter 120.

The power generator may be configured to generate power for opening and closing the door 30. The power generator may include a motor 112. The motor 112 may be disposed inside the apparatus body 102 to generate power, wherein the motor 112 may be rotated forward or reverse by receiving a control signal from a controller (not shown). The door 30 may be moved to an open position or a closed position through the forward rotation and the reverse rotation of the motor 112.

The power transmitter 120 may be disposed between the motor 112 and the hinge shaft 51 to transmit the power generated from the motor 112 to the hinge shaft 51. That is, the power generated by the motor 112 may be transmitted to the hinge shaft 51 through the power transmitter 120 so that the door 30 may be operated.

The power transmitter 120 may include a plurality of driving gears 122 rotated in conjunction with the motor 112 and a rotary gear 124 engaged with the plurality of driving gears 122 and mounted on the hinge shaft 51. The plurality of driving gears 122 and the rotary gear 124 may include gear teeth at least one part of their circumferences.

The power transmitter 120 may be configured to convert a power transmission state into a power non-transmission state, wherein the power transmission state may be a state in which the power of the motor 112 is transmitted to the hinge shaft so that the opening and closing of the door 30 is switched to be automatically performed or manually performed, and the power non-transmission state is a state in which the power is not transmitted to the hinge shaft.

The power transmitter 120 may include a motor side gear 132 rotated in conjunction with the motor 112, a door side gear 134 rotated in conjunction with the opening and closing of the door 30, a center gear 136 engaged with the motor side gear 132, and a pair of idle gear 138 (138*a* and 138*b*) engaged with the center gear 136. The motor side gear 132 and the door side gear 134 may be configured such that a plurality of gears is engaged with each other in series.

The motor side gear 132 may be configured such that one side of the motor side gear 132 is engaged with a rotary shaft 112*a* of the motor 112 and the other side of the motor side gear 132 is engaged with the center gear 136. In this embodiment, a plurality of motor side gears 132 may be provided, wherein the motor side gear 132 that is the closest to the motor 112 may be engaged with the rotary shaft 112*a*, and the motor side gear 132 that is the closest to the hinge shaft 51 may be engaged with the center gear 136.

The door side gear 134 may be configured such that one side of the door side gear 134 is engaged with the center gear 136 and the other side of the door side gear 134 is engaged with the rotary gear 124 coupled to the hinge shaft 51, but is not limited thereto. A plurality of the door side gear 134 may be provided, wherein the door side gear 134 that is the closest to the motor 112 may be engaged with the center gear 136 and the door side gear 134 that is the closest to the hinge shaft 51 may be engaged with the rotary gear 124.

Figure 8:
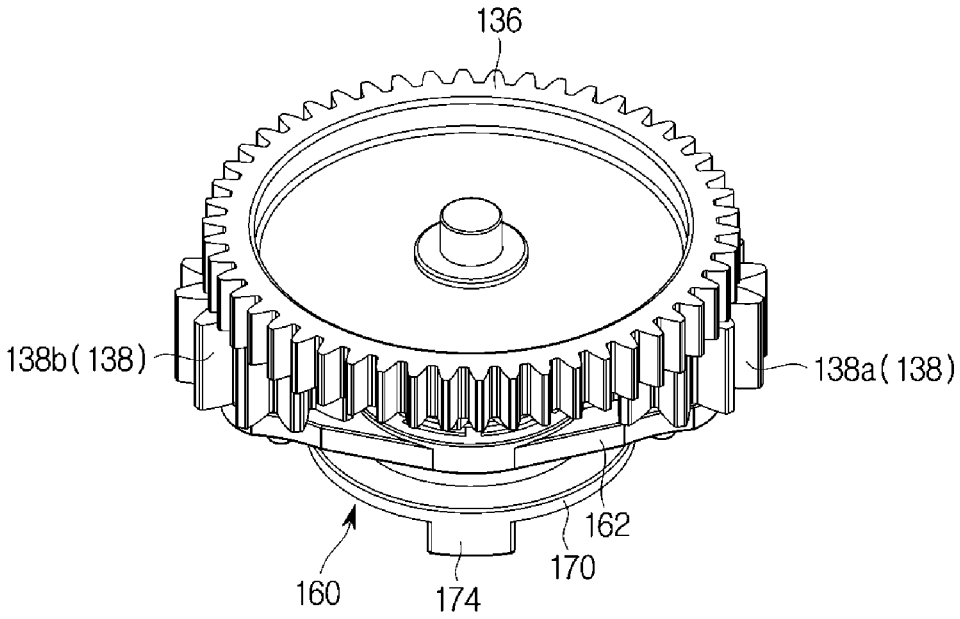
FIGS. 8 and 9 are perspective views from above and below of the center gear and a switching unit of the refrigerator according to an embodiment.
Figure 9:
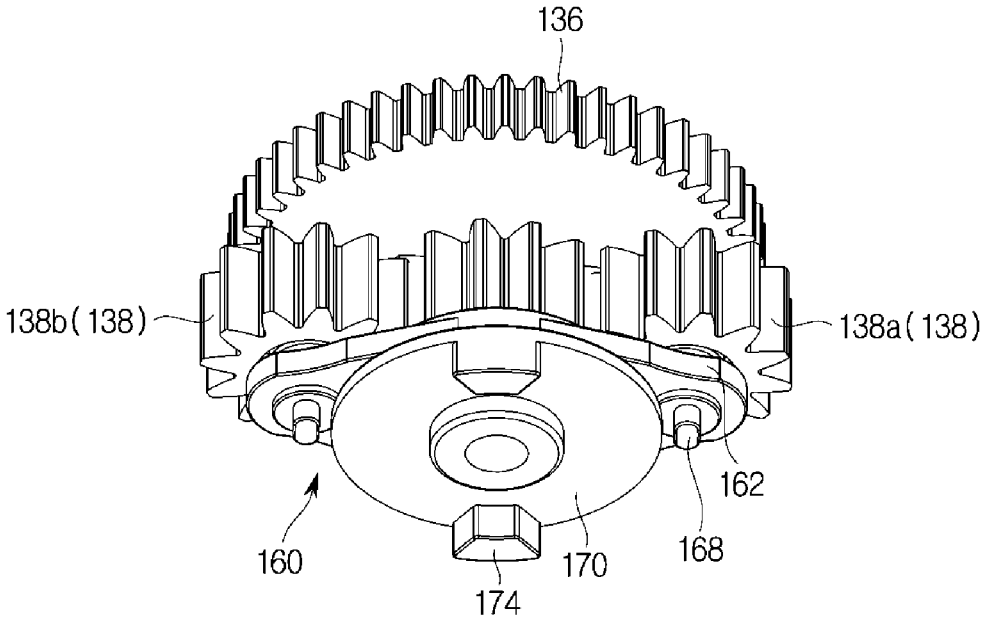
Figure 10:
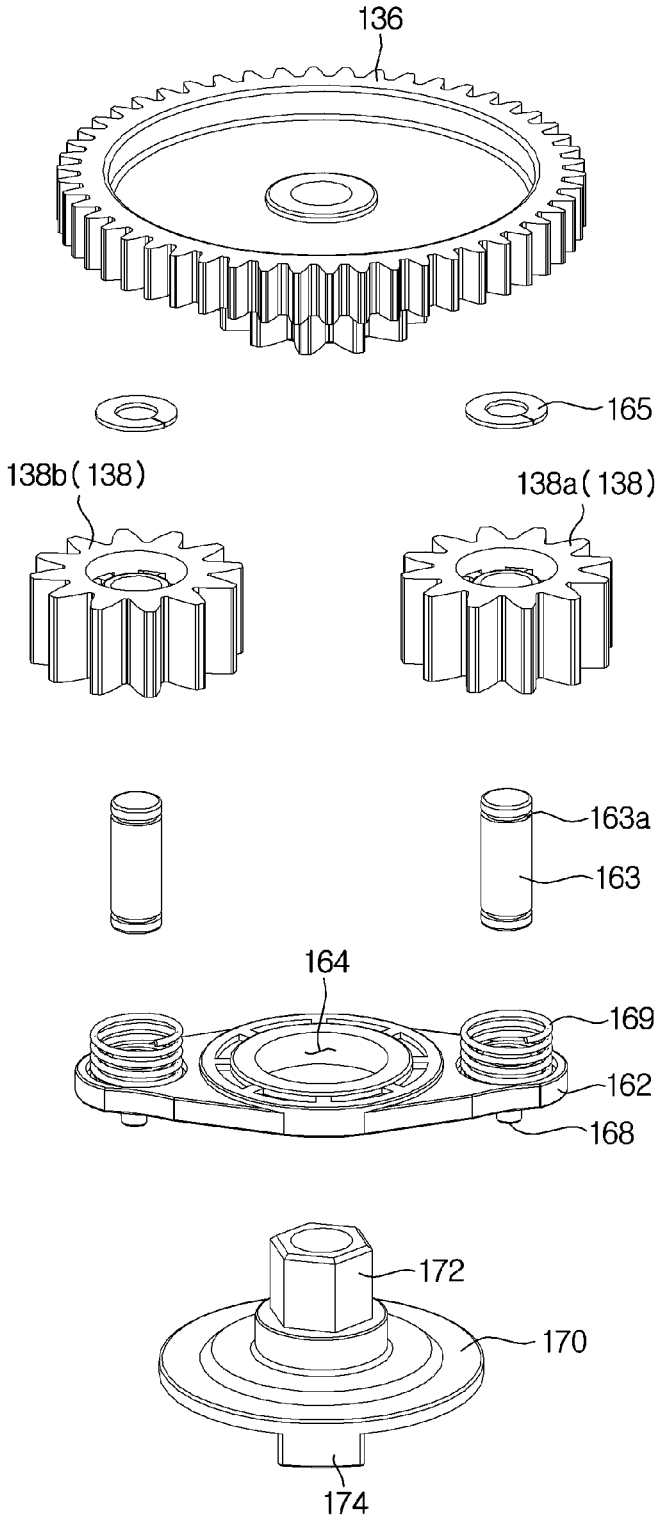
FIG. 10 is an exploded perspective view of the center gear and the switching unit of the refrigerator according to an embodiment.

FIGS. 8 and 9 are perspective views from above and below of the center gear and a switching unit of the refrigerator according to an embodiment, and FIG. 10 is an exploded perspective view of the center gear and the switching unit of the refrigerator according to an embodiment.

The power transmitter 120 may include a switching unit 160. The switching unit 160 may be configured to rotate the pair of the idle gears 138 (138*a* and 138*b*) along the circumference of a rotational axis of the center gear 136. The switching unit 160 may include a switching member 162 rotated about the rotational axis of the center gear 136 and to which the idle gear 138 is mounted, and a mounting member 170 to which the center gear 136 is mounted.

The switching member 162 may include an idle gear mounting shaft 163 on which the pair of idle gears 138 are mounted, and a through hole 164. The switching member 162 may be formed in a substantially flat plate shape.

A mounting elastic member 169 may be mounted to the idle gear mounting shaft 163 and may include an elastic member such as a spring. The mounting elastic member 169 may serve as a buffer against impact transmitted to the idle gear 138.

The mounting member 170 may include a center gear mounting shaft 172 on which the center gear 136 is mounted. The switching member 162 may be disposed between the mounting member 170 and the center gear 136. The mounting member 170 may be rotated in conjunction with the center gear 136 and configured to be rotated independently of the switching member 162. That is, the mounting member 170 and the center gear 136 may be configured to be rotated together, and the switching member 162 may be rotated independently of the mounting member 170 and the center gear 136.

The switching member 162 may be positioned on the upper surface of the mounting member 170 as the center gear mounting shaft 172 passes through the through hole 164. The idle gear 138 may be mounted on the idle gear mounting shaft 163 and thus the center gear 136 may be mounted on the center gear mounting shaft 172.

The mounting elastic member 169 may be mounted on the idle gear mounting shaft 163, the idle gear 138 may be mounted on the mounting elastic member 169, and a pressure member 165 pressing the idle gear 138 is passed therethrough so that the upward force of the idle gear 138 from the mounting elastic member 169 may be applied. The pressing member 165 may be configured to be engaged with a concave groove 163*a* formed along the circumferential direction on the outer circumferential surface of the idle gear mounting shaft 163.

According to this configuration, the idle gear 138 may be moved among positions in conjunction with the motor 112, wherein the positions may include a forward rotation power transmission position 139*a* for transmitting the forward rotation of the motor 112, a reverse rotation transmission position 139*b* for transmitting the reverse rotation of the motor 112, and a power non-transmission position 139*c* for not transmitting the power. As the center gear 136 and the switching unit 160 rotate the pair of the idle gears 138 to allow one of the idle gears 138 to engage with the door side gear 134, the power transmission state may be acquired, and as the engagement between the pair of the idle gear 138 and the door side gear 134 is released, the power non-transmission state may be acquired.

That is, the state in which the idle gear 138 is in the forward rotation power transmission position 139*a* or the reverse rotation power transmission position 139*b* is the power transmission state, and the state in which the idle gear 138 is in the power non-transmission position 139*c* is the power non-transmission state.

Figure 11:
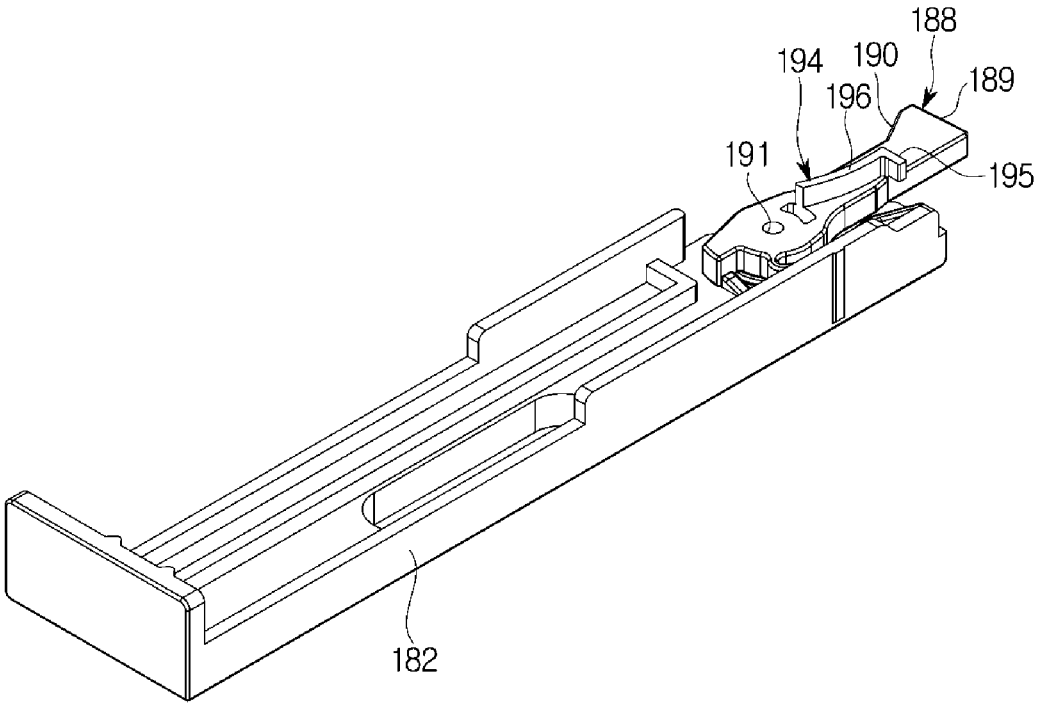
FIG. 11 is a view of a sliding member and a power switching member of the refrigerator according to an embodiment.
Figure 12:
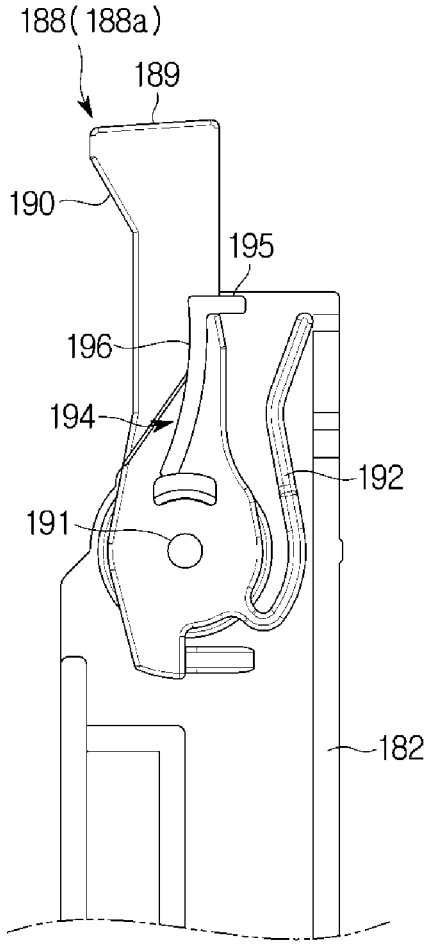
FIGS. 12 and 13 are views of operations of the sliding member and the power switching member of the refrigerator according to an embodiment.
Figure 13:
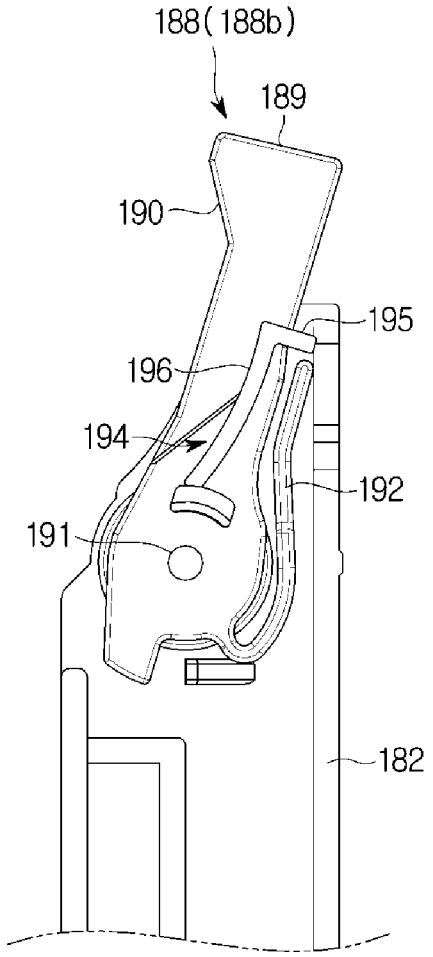
Figure 14:
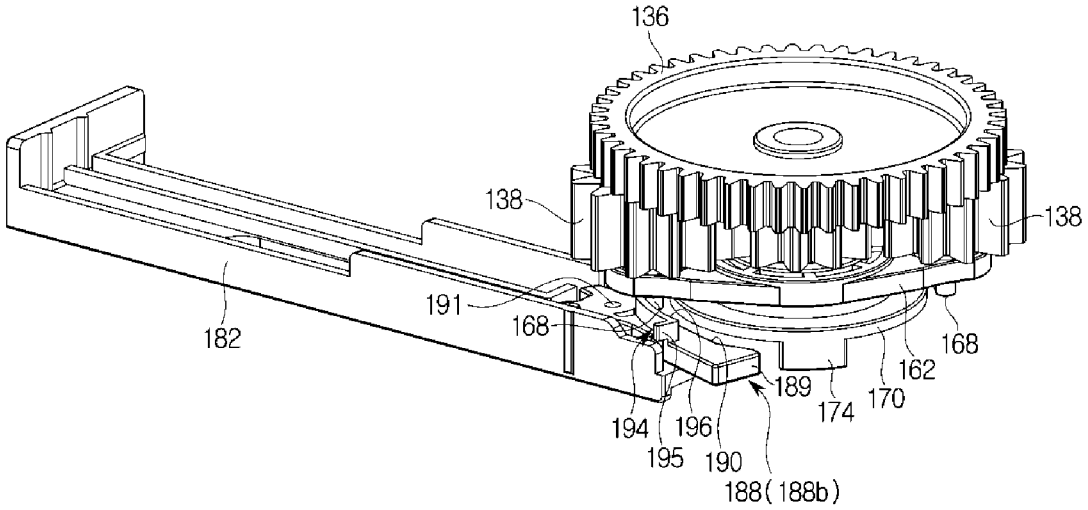
FIG. 14 is a view of the relationship between the pressure device and the driving gear of the refrigerator according to an embodiment.

FIG. 11 is a view of a sliding member and a power switching member of the refrigerator according to an embodiment, FIGS. 12 and 13 are views of operations of the sliding member and the power switching member of the refrigerator according to an embodiment, and FIG. 14 is a view of the relationship between the pressure device and the driving gear of the refrigerator according to an embodiment.

The door opening and closing apparatus 100 may include the pressure device 180 (refer to FIG. 7). The pressure device 180 may be configured to press the body 10 so that the door 30 is opened. In order to open the door 30 in the closed state, it may be required to release the magnetic attraction between the magnet in the gasket 36 of the door 30 and the body 10. Therefore, after the door 30 and the body 10 are apart from each other by using the pressure device 180, it may be possible to move the door 30 to a direction in which the door 30 is opened, by using the power transmitter 120. With the configuration of the pressure device 180, it may be possible to reduce an initial force, which is needed for switching the door 30 from the closed position to the open position, and thus it may be possible to reduce the size of the motor 112.

The pressure device 180 may be operated when the idle gear 138 is in the power non-transmission position 139*c*. That is, after the door 30 and the body 10 are separated from each other by the pressure device 180, the idle gear 138 may be moved to the forward rotation power transmission position 139*a* to transmit the power in the direction in which the door 30 is opened. The door opening and closing apparatus 100 may include a delay member 194 to allow the pressure device 180 to be operated when the idle gear 138 is in the power non-transmission position 139*c*. The delay member 194 will be described later.

The pressure device 180 may include a sliding member 182 moved in a slide manner, in conjunction with the power transmitter 120 and a pressing member 184 (refer to FIGS. 2 to 6) rotated by the sliding movement of the sliding member 182 to press the body. The pressing member 184 may be rotatable with respect to a rotary shaft 184*a* in conjunction with the sliding movement of the sliding member 182. That is, the sliding member 182 may press one side of the pressing member 184 while sliding, and the pressed pressing member 184 may be rotated about the rotary shaft 184*a* to press the body 10 toward the other side of the pressing member 184. The door 30 may be provided with a pressing hole 185 configured to allow the pressing member 184 to protrude toward the body 10.

The sliding member 182 may be provided to slide along a longitudinal direction thereof. At one end of the sliding member 182, the pressing member 184 may be disposed. At the other end of the sliding member 182, the power may be transmitted from the power transmitter 120.

The pressure device 180 may include an elastic return member 186 (refer to FIGS. 2 to 6). The elastic return member 186 may be configured to allow the sliding member 182 and the pressing member 184, which are pressed by a pressing protrusion 174 and then presses the body 10, to resiliently return to an initial position. The arrangement of the elastic return member 186 is not limited thereto, and thus there may be no limitation in the arrangement of the elastic return member 186 as long as returning the sliding member 182 and the pressing member 184 to the initial position. In this embodiment, the elastic return member 186 may be disposed on the rotary shaft 184*a* of the pressing member 184 so as to resiliently return the pressing member 184 and the sliding member 182 to the initial position.

The pressure device 180 may include a power conversion member 188. The power conversion member 188 may be disposed at the other end of the sliding member 182, wherein the power conversion member 188 may be configured to convert the rotational force of the door side gear 134 of the driving gear 122, into the power in the sliding direction of the sliding member 182. The power conversion member 188 may be rotatably provided on the sliding member 182.

The power conversion member 188 may include a pressed surface 189 pressed by at least one pressing protrusion 174 provided on the door side gear 134. Particularly, the at least one pressing protrusion 174 may be provided on a rear surface of the mounting member 170 and the at least one pressing protrusion 174 may press the pressed surface 189 by the rotation of the mounting member 170.

When the motor 112 is reversely rotated to move the door 30 in the direction in which the door 30 is closed, the power conversion member 188 may not transmit the power of the motor 112 to the pressure device 180. When the motor 112 is forwardly rotated to move the door 30 in the direction in which the door 30 is opened, the power conversion member 188 may transmit the power of the motor 112 to the pressure device 180.

As illustrated in FIG. 11, the power conversion member 188 may be disposed at the other end of the sliding member 182, and when the motor 112 is forwardly rotated, the pressed surface 189 may be pressed by the pressing protrusion 174. The power conversion member 188 may be provided with a guide surface 190 so that the power conversion member 188 may be rotated by the movement of the pressing protrusion 174 when the motor 112 is reversely rotated.

The power conversion member 188 may be moved between a normal position 188*a* in which an external force is not applied, and a rotation position 188*b* in which the power conversion member 188 is rotated about a rotation axis 191 from the normal position 188*a*. The rotation position 188*b* is a position in which the power conversion member 188 is rotated in the direction away from the rotation axis of the center gear 136 from the normal position 188*a*. The power conversion member 188 may include an elastic portion 192 to resiliently return the power conversion member 188 from the rotation position 188*b* to the normal position 188*a*.

The power conversion member 188 may be disposed below the mounting member 170, wherein the pressed surface 189 and the guide surface 190 may be disposed in the movement path of the pressing protrusion 174 when the power conversion member 188 is in the normal position 188*a*.

The pressing protrusion 174 may be rotated in conjunction with the rotation of the center gear 136, and the power conversion member 188 may be configured to convert the rotational force of the pressing protrusion 174 into the power in the sliding direction of the sliding member 182. According to an embodiment, the pair of the pressing protrusions 174 is arranged in the mounting member 170, but is not limited thereto. Alternatively, one or more pressing protrusions 174 may be provided.

The pressure device 180 may include the delay member 194.

The delay member 194 may be configured to restrict the rotation of the switching member 162 to maintain the power non-transmission position 139*c* in which the idle gear 138 is not engaged with the door side gear 134.

The delay member 194 may be provided on the power conversion member 188. The switching member 162 may include a delay protrusion 168 in contact with the delay member 194.

The delay protrusion 168 may be formed in a protruding shape on the rear surface of the switching member 162, wherein the pair of delay protrusions 168 may be provided on the rotation axis of the idle gear 138, respectively. The delay protrusion 168 may be configured such that when the switching member 162 is rotated, one side of the delay protrusion 168 may be not in contact with one surface of the power conversion member 188. That is, the delay protrusion 168 may be configured to not be in contact with the power conversion member 188 and configured to be in contact with the delay member 194 disposed on the power conversion member 188.

The delay member 194 may include a delay contact surface 195 on which the delay protrusion 168 abuts, and a rotation guide surface 196. The delay contact surface 195 may be configured to restrict the movement of the delay protrusion 168 as described above, and to maintain the power non-transmission position 139*c* in which the idle gear 138 is not engaged with the door side gear 134. The rotation guide surface 196 will be described in the description of the operation of the door opening and closing apparatus 100.

Hereinafter the operation of the door opening and closing apparatus of the refrigerator will be described.

FIGS. 15 to 20 are views of operations of the door opening and closing apparatus of the refrigerator according to an embodiment.

First, a case of moving the door 30 in the closed position to the opening direction will be described.

Figure 15:
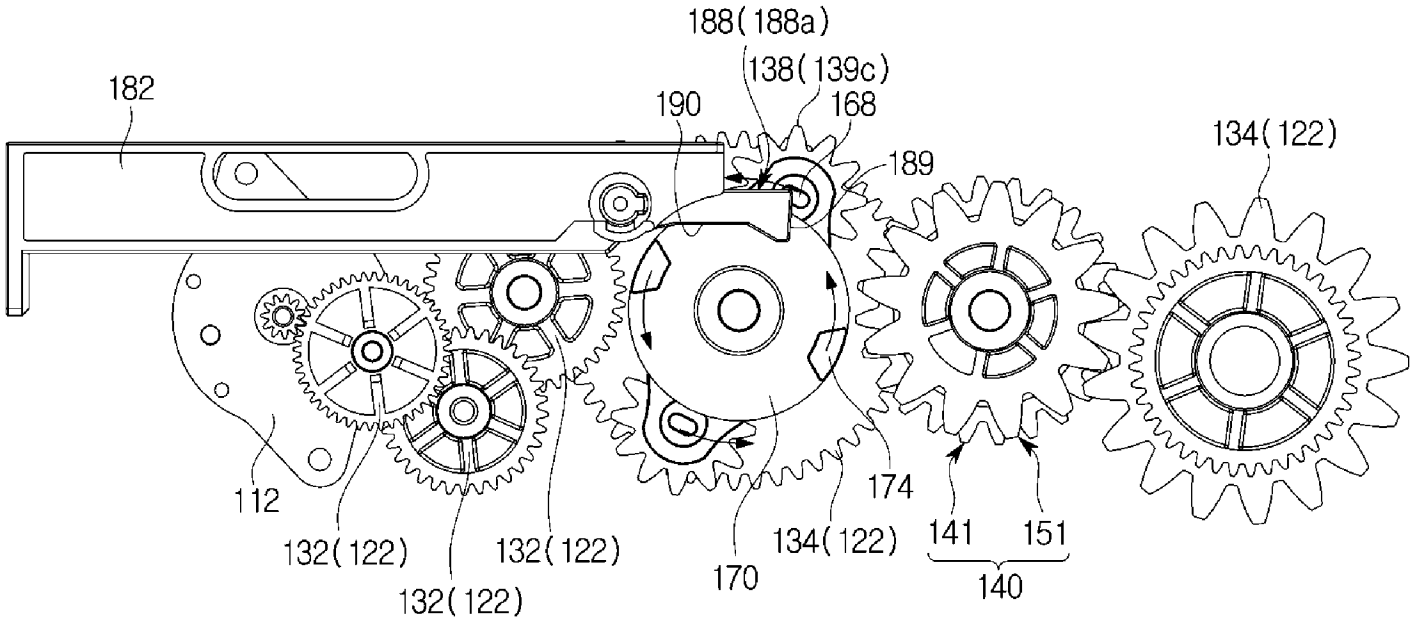
FIGS. 15 to 20 are views of operations of the door opening and closing apparatus of the refrigerator according to an embodiment.
Figure 16:
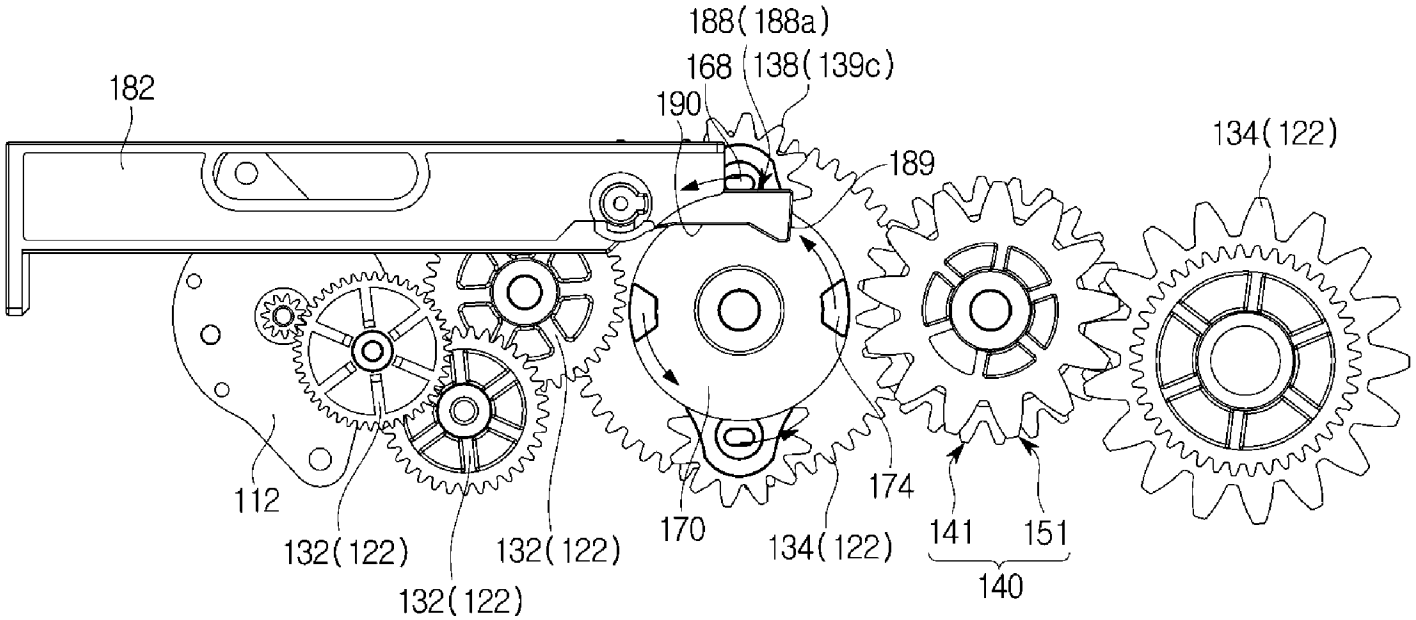

When the motor 112 is rotated forward in a state in which the door 30 is in the closed position, the switching unit 160 may move the pair of the idle gear 138 from the power non-transmission position 139*c* toward the forward rotation power transmission position 139*a*, in conjunction with the rotation of the center gear 136 as illustrated in FIGS. 15 and 16. Since the pair of the idle gears 138 is rotated together with the switching member 162, the delay protrusion 168 provided on the switching member 162 may be rotated toward the delay member 194.

As illustrated in FIG. 16, the rotation of the switching member 162 and the rotation gear 138 may be restricted while the delay protrusion 168 comes into contact with the delay member 194, and thus the power non-transmission position 139*c* of the idle gear 138 may be maintained.

Figure 17:
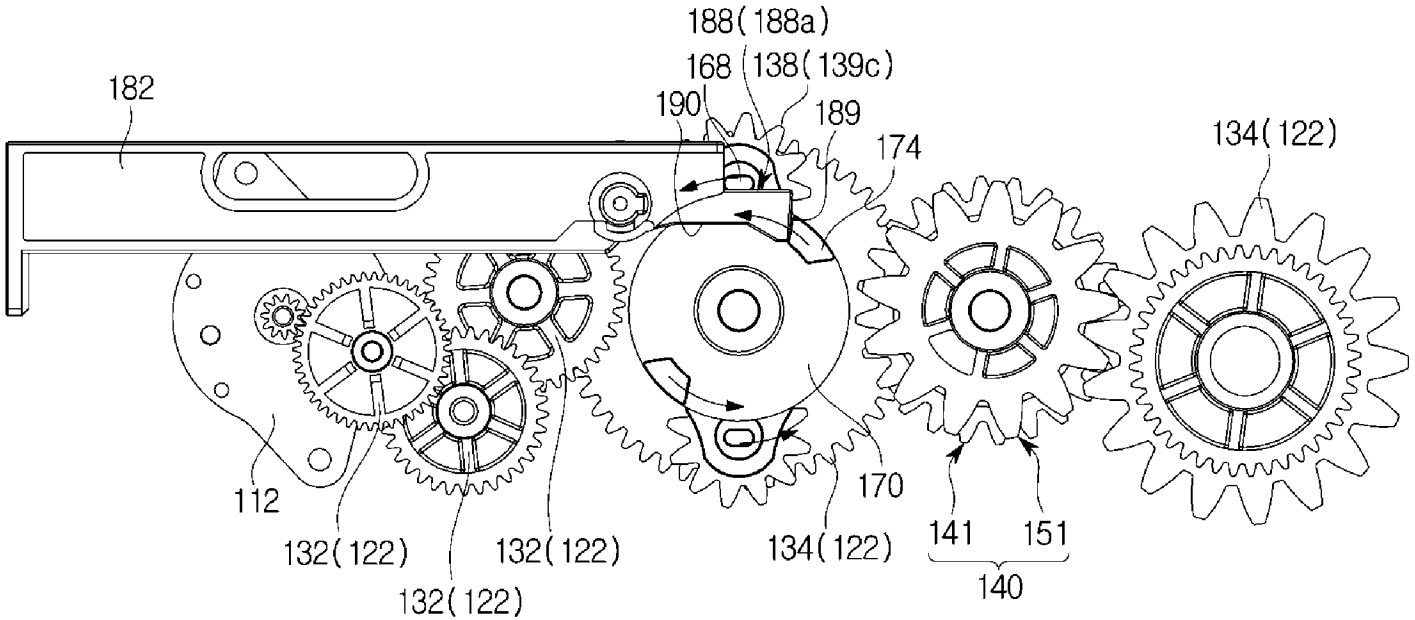
Figure 18:
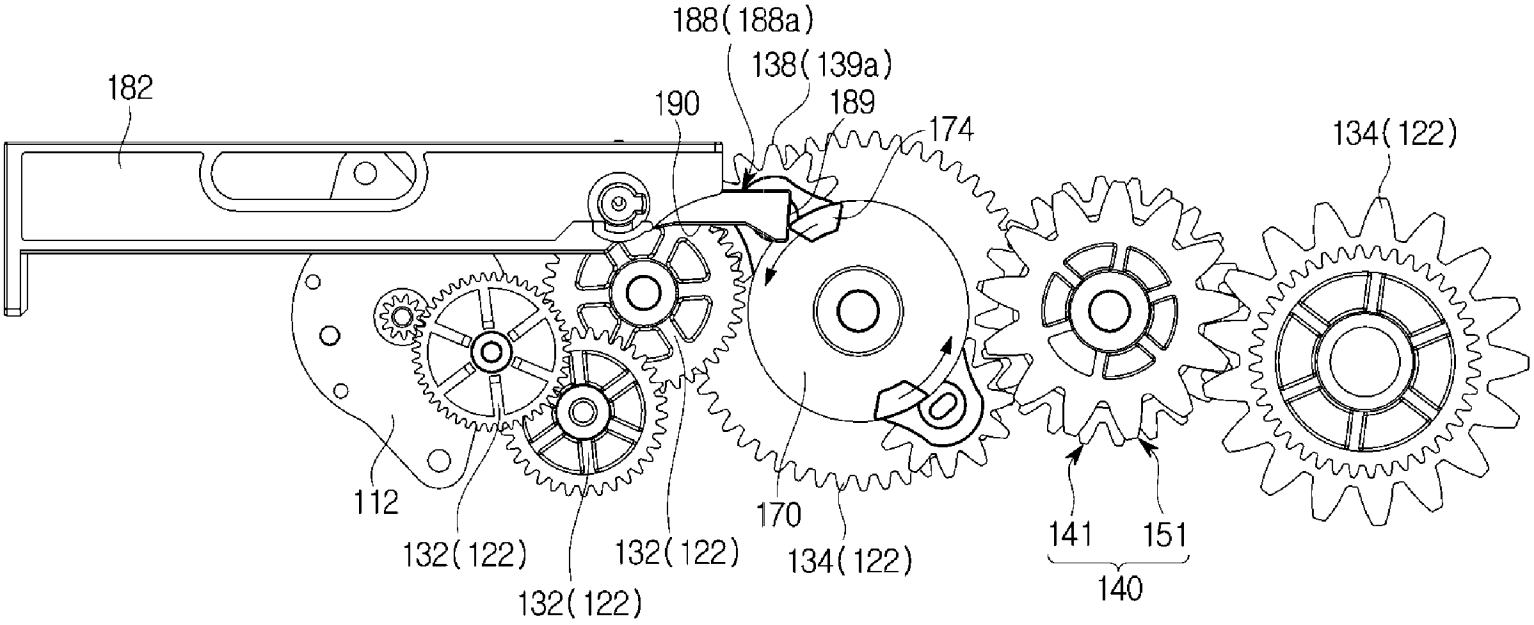

When the motor 112 is further rotated forward, the pressing protrusion 174 installed in the mounting member 170 may press the power conversion member 188 and the pressure device 180 by the rotation of the center gear 136 and the mounting member 170, wherein the rotation of the center gear 136 and the mounting member 170 is performed independently of the switching member 162, as illustrated in FIGS. 17 and 18.

Due to the pressure against the pressure device 180, the sliding member 182 may be moved in a slide manner, and the pressing member 184 may press the body so that the door 30 is separated from the body.

When the motor 112 is further rotated forward, the idle gear 138 and the switching member 162, which were restricted in rotation by the delay member 194, may be further rotated, and then placed in the forward rotation power transmission positions 139*a* (refer to FIG. 18). The power generated by the motor 112 may be transmitted to the motor side gear 132, the center gear 136, the idle gear 138 and the door side gear 134 so that as the door 30 is moved to the opening direction.

Figure 21:
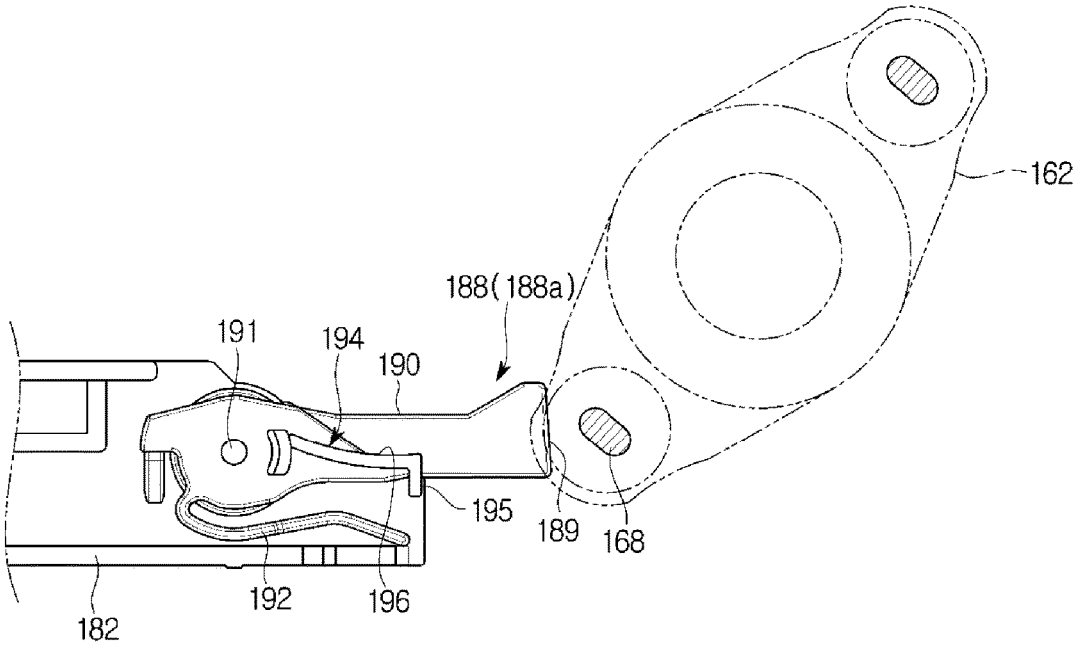
FIGS. 21 to 23 are views of an operation of a power conversion member of the refrigerator according to an embodiment.
Figure 22:
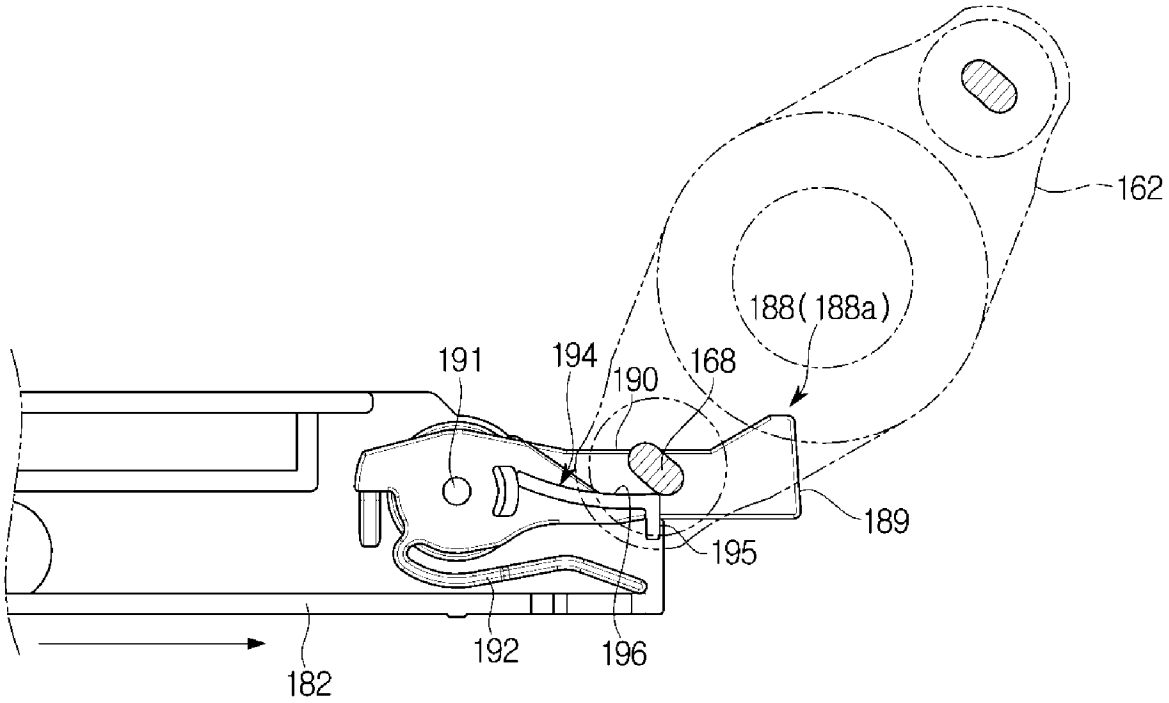
Figure 23:
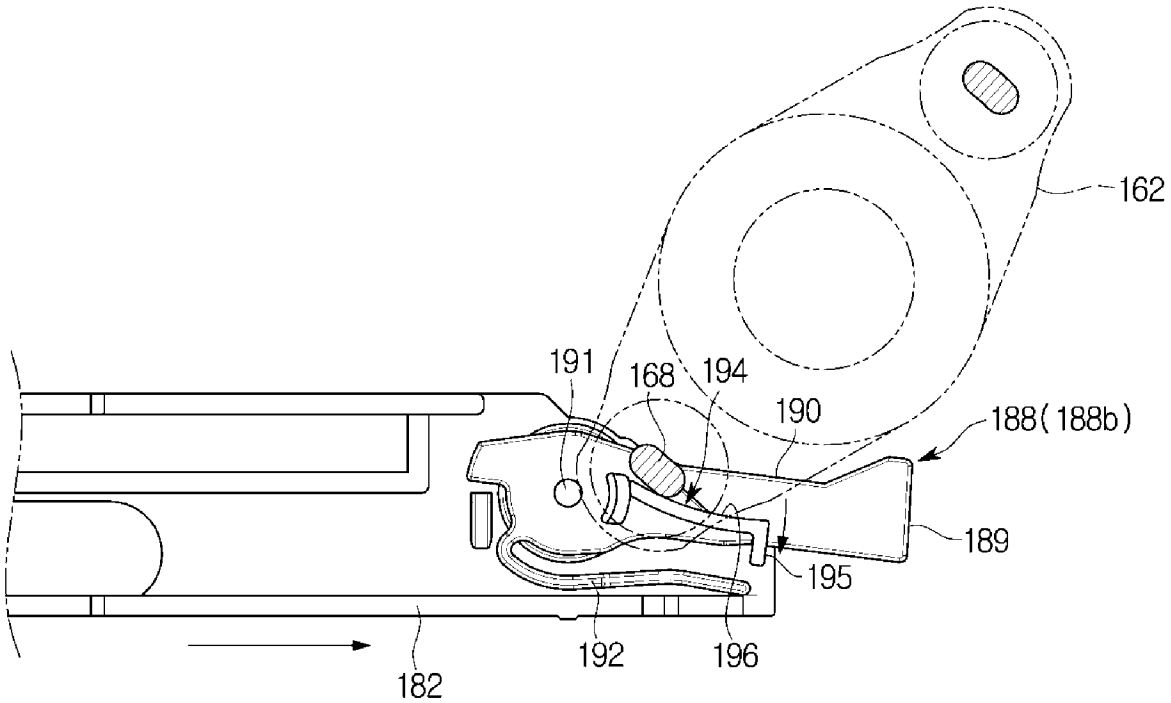

FIGS. 21 to 23 are views of an operation of a power conversion member of the refrigerator according to an embodiment. The pressure device 180 pressed by the pressing protrusion 174 may be moved to the initial position by the elastic return member 186. At this time, the idle gear 138 may be placed in the forward rotation power transmission position 139*a* and the delay protrusion 168 may be also located in correspondence with the position of the idle gear 138 at the rear face of the switching member 162. As the pressure device 180 returns to the initial position, the rotation guide surface 196 of the retardation member 194 may be pressed by the delay protrusion 168. The rotation guide surface 196 may be formed to be curved in a direction away from the rotation axis of the center gear 136. As the rotation guide surface 196 may slide along the delay protrusion 168 while the pressure device 180 returns to the initial position due to the above mentioned configuration, the power conversion member 188 may be moved from the normal position 188*a* to the rotation position 188*b*. That is, the pressed surface 189 of the power conversion member 188 may be escaped from the movement path of the pressing protrusion 174. Therefore, although the motor 112 continues to be rotated forward, the pressure device 180 may be not affected by the pressing protrusion 174.

Hereinafter a case of moving the door 30 in the open state to the closing direction will be described.

Figure 19:
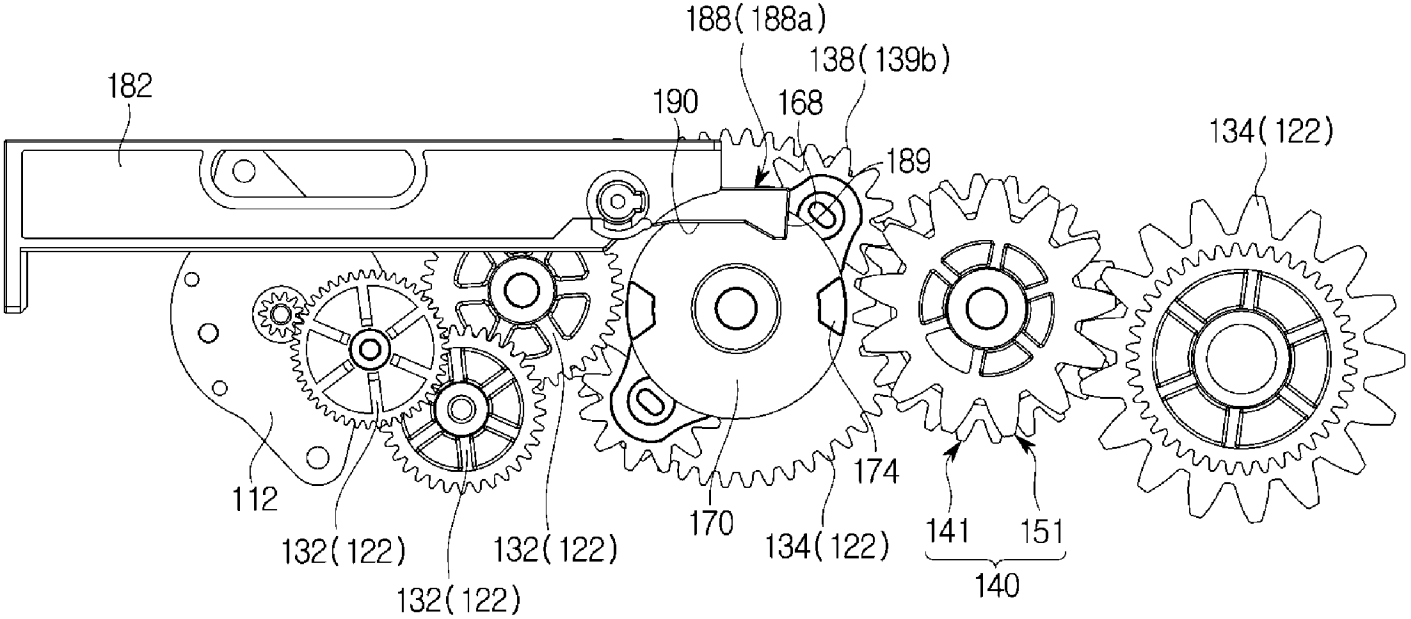
Figure 20:
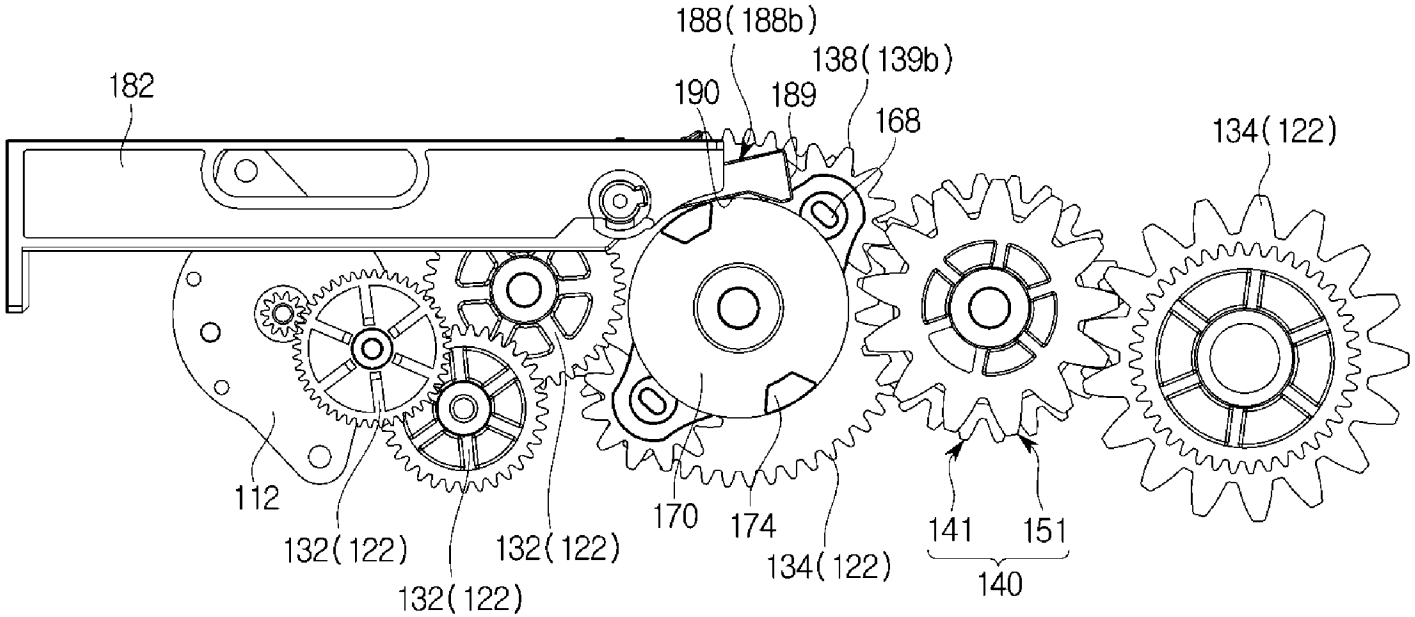

When the motor 112 is rotated in the reverse direction in a state in which the door 30 is in the open position, the mounting member 170 may be rotated in conjunction with the center gear 136 as shown in FIGS. 19 and 20, and thus the plurality of pressing protrusions 174 may be rotated toward the power conversion member 188. As the pressing protrusion 174 comes into contact with the guide surface 190 of the power conversion member 188 and presses the guide surface 190, the power conversion member 188 may be moved from the normal position 188*a* to the rotation position 188*b* by the pressure of the pressing protrusion 174. Therefore, the power conversion member 188 may be not affected by the pressing protrusion 174, which is different from the case in which the door 30 is moved from the closed position to the open position.

The power of the motor 112 in the reverse rotation direction may move the idle gear 138 to the reverse rotation transmission position 139*b*. Accordingly, the power generated by the motor 112 may be transmitted to the motor side gear 132, the center gear 136, the idle gear 138 and the door side gear 134 so that the door 30 is moved to the closing direction.

Figure 24:
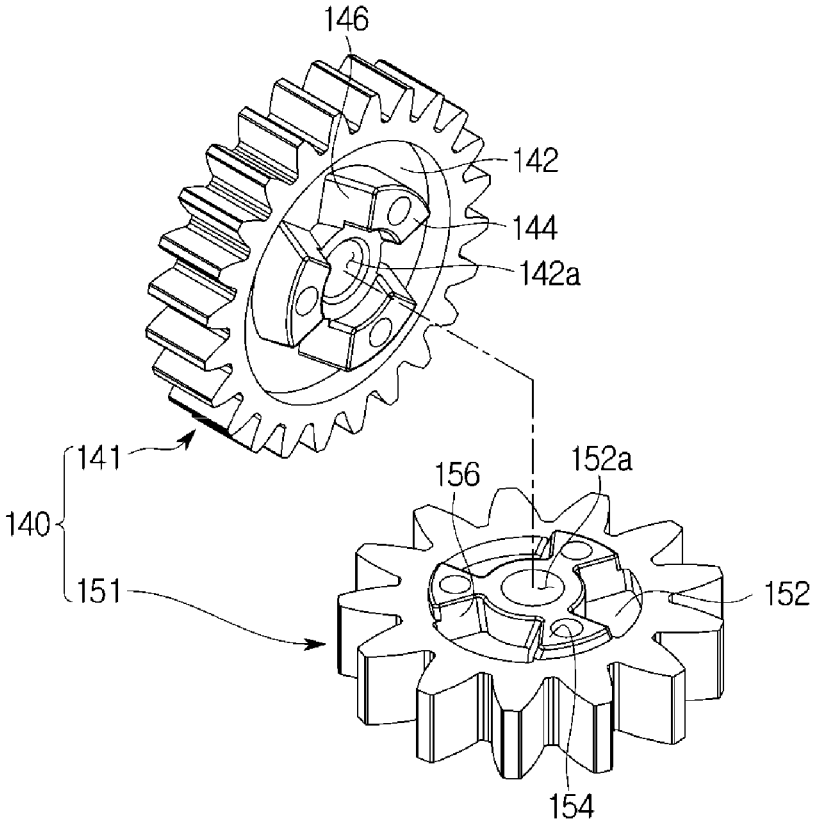
FIG. 24 is an exploded perspective view of an intermittent gear of the refrigerator according to an embodiment.
Figure 25:
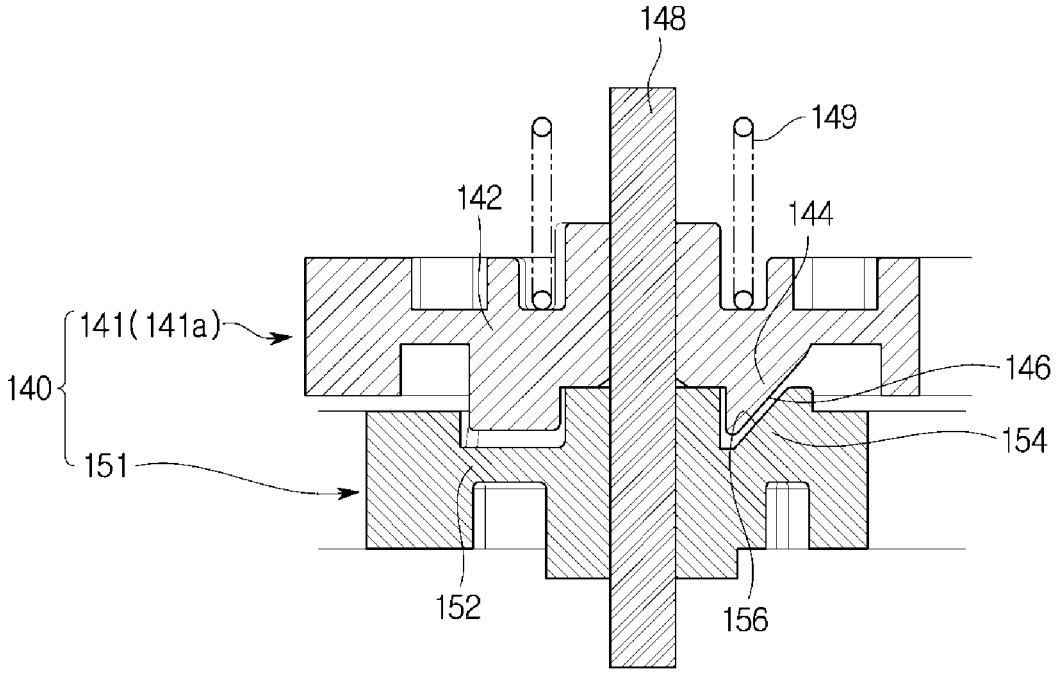
FIG. 25 is a cross-sectional view of the intermittent gear of the refrigerator according to an embodiment.

FIG. 24 is an exploded perspective view of an intermittent gear of the refrigerator according to an embodiment, and FIG. 25 is a cross-sectional view of the intermittent gear of the refrigerator according to an embodiment.

The door side gear 134 may include a pair of intermittent gears 140. When the door 30 is moved by an external force in a state in which the door opening and closing apparatus 100 is not operated, or when an external force is applied to the direction opposite to the rotation of the motor 112 in a state in which the door opening and closing apparatus 100 is operated, or when an external force greater than the rotational force of the motor 112 is generated in the same direction, an unnecessary load may be applied to the driving gears 122 engaged with the rotary gear 124 of the hinge shaft 51. Therefore, the driving gears 122 or the motor 112 may be damaged. The intermittent gear 140 may be configured to prevent the external force from being transmitted to the driving gears 122 or the motor 112.

When the door opening and closing apparatus 100 is operated normally to move the door 30 from the closed position to the open position or from the open position to the closed position, the pair of intermittent gears 140 may be operated as the driving gear 122. That is, the pair of intermittent gears 140 may be configured to interrupt the power when the external force is applied to the door 30, so that the external force is not transmitted to the driving gears 122 or the motor 112. That is, the intermittent gear 140 may be arranged to transmit the power from the motor side gear 132 to the door side gear 134, while being arranged to interrupt the load transmitted from the door side gear 134 to the motor side gear 132.

The pair of intermittent gears 140 may include a first intermittent gear 141 and a second intermittent gear 151. The first intermittent gear 141 may be configured to be engaged with one of the pair of the idle gears 138. The second intermittent gear 151 may be provided to be rotated about the same axis as the first intermittent gear 141 and rotated together with the first intermittent gear 141. That is, when the motor 112 is rotated forward, the pair of intermittent gears 140 may receive the power from the idle gear 138 in the forward power transmission position 139*a* and transmit the power to the rotary gear 124. In contrast, when the motor 112 is rotated in the reverse direction, the pair of intermittent gears 140 may receive the power from the idle gear 138 in the reverse power transmission position 139*b* and transmit the power to the rotary gear 124.

The first intermittent gear 141 may be moved between a coupling position 141*a* in which the first intermittent gear 141 is engaged with the second intermittent gear 151 to transmit the power to the second intermittent gear 151, and a separated position 141*b* in which the first intermittent gear 141 is moved from the coupling position 141*a* and separated from the second intermittent gear 151. The first intermittent gear 141 may be moved between the coupling position 141*a* and the separated position 141*b* along an intermittent gear rotary shaft 148. According to an embodiment, the first intermittent gear 141 may be configured to receive the power from the idle gear 138 so that the first intermittent gear 141 may be moved between the coupling position 141*a* and the separated position 141*b*, but is not limited thereto. Therefore, the first intermittent gear 141 may be configured to receive the power from the idle gear 138 so that the second intermittent gear 151 may be moved between the coupling position 141*a* and the separated position 141*b*. The first intermittent gear 141 may be provided with an intermittent gear elastic member 149 so that the first intermittent gear 141 in the separated position 141*b* resiliently returns to the coupling position 141*a*. The intermittent gear elastic member 149 may be disposed with respect to the intermittent gear rotary shaft 148 and configured to resiliently support the first intermittent gear 141.

The first intermittent gear 141 has been described to be engaged with the idler gear 138, but is not limited thereto. For example, the pair of intermittent gear 140 may be engaged with the rotary gear 124, and when the plurality of the door side gear 134 is provided, the intermittent gear 140 may be located in an intermediate position and transmit or interrupt the power.

The first and second intermittent gear 140 may include first and second gear bodies 142 and 152, and first and second inclined boss portions 144 and 154. The first and second gear bodies 142 and 152 may form a body of the first and second intermittent gears 141 and 151, respectively, wherein first and second hollow portions 142*a* and 152*a* may be provided in the first and second gear bodies 142 and 152 so that the intermittent gear rotary shaft 148 is passed through.

The first and second inclined boss portions 144 and 154 may be formed on surfaces facing each other in the first and second gear bodies 142 and 152. The first and second inclined boss portions 144 and 154 may protrude from the first and second gear bodies 142 and 152, respectively. When the first intermittent gear 141 is in the coupling position 141*a*, a side surface of the first and second inclined boss portions 144 and 154 may come into contact with each other. Particularly, when the first intermittent gear 141 is in the coupling position 141*a*, a side surface of the first and second inclined boss portions 144 and 154 may come into contact with each other so as to transmit the power from the first intermittent gear 141 to the second intermittent gear 151. In addition, when the first intermittent gear 141 is in the separated position 141*b*, the first and second inclined boss portions 144 and 154 may be separated from each other so that any one inclined boss portion is not placed on the movement path of the other boss portion.

A plurality of the first and second inclined boss portions 144 and 154 may be alternately disposed along the circumferential direction. In this embodiment, the first and second inclined boss portions are respectively provided three each, wherein three second inclined boss portions 154 may be disposed between three first inclined boss portions 144.

The first and second inclined boss portions 144 and 154 may include first and second inclined surfaces 146 and 156, respectively. The first and second inclined surfaces 146 and 156 may be formed inclined with respect to the intermittent gear rotary shaft 148. That is, the first inclined surface 146 may be inclined toward the circumferential direction with respect to a direction in which the first intermittent gear 141 is directed to the second intermittent gear 151, and the second inclined surface 156 may be inclined toward the circumferential direction with respect to a direction in which the second intermittent gear 151 is directed to the first intermittent gear 141. When the first intermittent gear 141 is in the coupling position 141*a*, the first and second inclined surfaces 146 and 156 may come into contact with each other to transmit the power from the first intermittent gear 141 to the second intermittent gear 151. When the first intermittent gear 141 is in the separated position 141*b*, the first and second inclined surfaces 146 and 156 may be separated from each other to interrupt the transmission of the power between the first intermittent gear 141 and the second intermittent gear 151.

Hereinafter the operation of the intermittent gear 140 in the door opening and closing apparatus 100 of the refrigerator 1 will be described.

Figure 26:
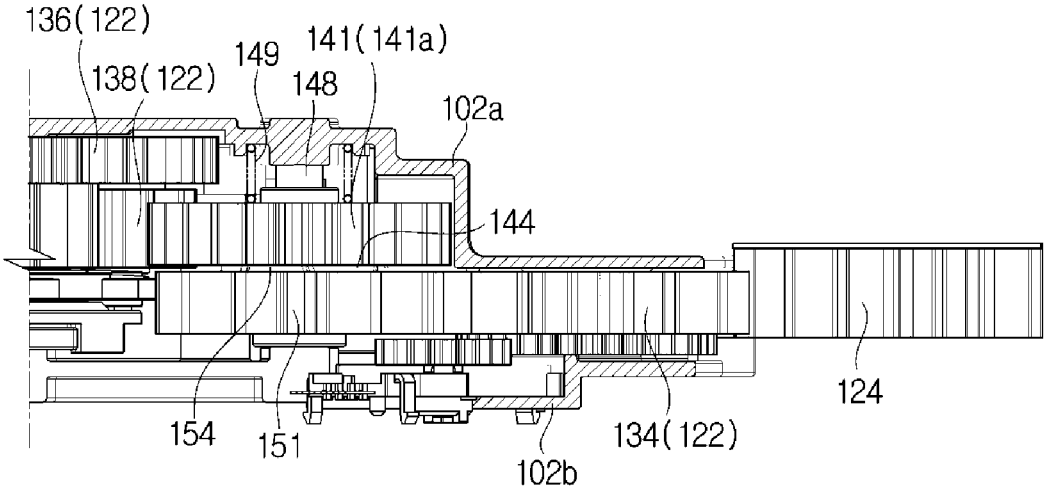
FIGS. 26 and 27 are views of the operation of the intermittent gear in the refrigerator according to an embodiment.
Figure 27:
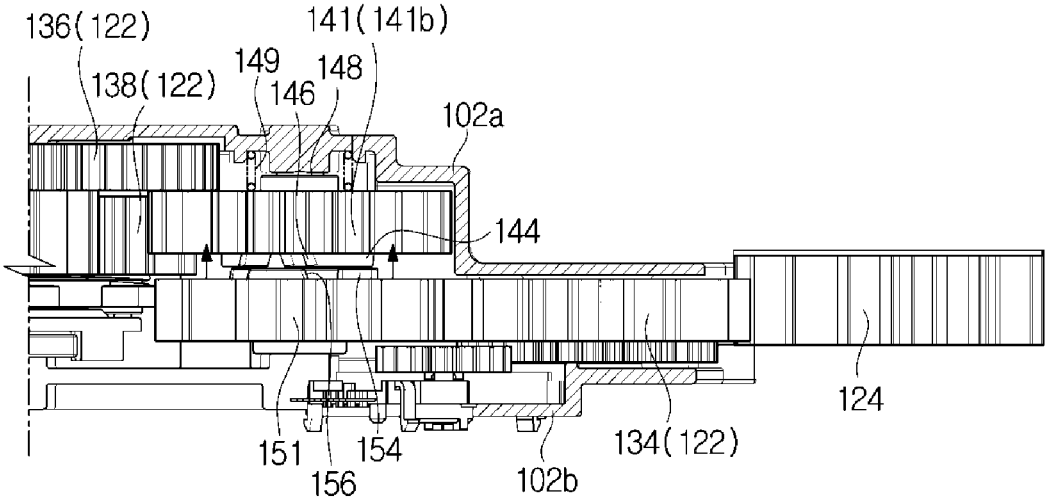

FIGS. 26 and 27 are views of the operation of the intermittent gear in the refrigerator according to an embodiment.

When the first intermittent gear 141 is in the coupling position 141*a*, the first and second inclined boss portions may be alternately disposed, as illustrated in FIG. 26.

As mentioned above, when the external force is applied to the door 30, the load may be generated in the hinge shaft 51.

The load generated in the hinge shaft 51 may be transmitted to the second intermittent gear 151 through the door side gear 134. When the load generated in the hinge shaft 51 is equal to less than the normal rotational force of the motor 112, the first and second inclined boss portions 144 and 154 of the first and second intermittent gears 141 and 151 may be rotated with each other while being in contact with each other.

When the external force equal to greater than the normal rotational force of the motor 112 is applied or when the external force in the direction opposite to the rotation direction of the motor 112 is applied, a slip may be generated between the first inclined surface 146 of the first inclined boss portion 144 and the second inclined surface 156 of the second inclined boss portion 154.

For the convenience of description, a threshold of the power transmitted between the intermittent gears 141 and 142 is referred to as Lc. A case in which the door is opened or closed by an external force La, which is greater than Lc, without operating the door opening and closing apparatus, will be described. In this case, La may be transmitted to the hinge shaft and the hinge shaft gear. Since the intermittent gear transmits the power only when an external force less than Lc is applied, a slip may be generated and the power may be not transmitted. Accordingly, it may be possible to prevent the external force from being transmitted to the gears and the motor.

In a case of operating the door opening and closing apparatus, a case in which an external is applied to the direction in which the door is closed during the door is opened by the door opening and closing apparatus, or a case in which an external is applied to the direction in which the door is opened during the door is closed by the door opening and closing apparatus will be described. In addition, a case in which an external is applied to the direction in which the door is opened during the door is opened by the door opening and closing apparatus, or a case in which an external is applied to the direction in which the door is closed during the door is closed by the door opening and closing apparatus may be the same as the above mentioned case. In this case, Lm may be generated by the rotational force of the motor. Lm may be typically maintained to be less than Lc and thus when the door opening and closing apparatus is operated normally, a slip may be not generated between the intermittent gears 141 and 142. However, when Lm+Lb is greater than Lc since an external force corresponding Lb is applied, a slip may be generated between the intermittent gears 141 and 142 and thus it may be possible to prevent the power from being transmitted from the motor to the hinge shaft or to prevent the external force from being transmitted from the hinge shaft to the motor.

Therefore, a lower surface of the first inclined boss portion 144 may come into contact with an upper surface of the second inclined boss portion 154 and thus the power may be not transmitted between the first and second intermittent gears 141 and 151. That is, the first intermittent gear 141 may be moved to the separated position 141*b* and thus the power may be not transmitted between the first and second intermittent gears 141 and 151.

When the external force disappears, the first intermittent gear 141 may be moved from the separated position 141*b* to the coupling position 141*a* by the intermittent gear elastic member 149, and thus the first and second intermittent gears 141 and 151 may become a state in which the transmission of the power is available.

As is apparent from the above description, according to the proposed refrigerator, it may possible to automatically open and close a door by applying a door opening and closing apparatus.

It may possible to reduce the load transmitted to a motor when an external force is applied to the door of the refrigerator.

It may possible to reduce the size of the motor and the door opening and closing apparatus by reducing the load transmitted to the motor.

It may possible to improve the durability of the door opening and closing apparatus.

Although a few embodiments of the present disclosure have been shown and described, it would be appreciated by those skilled in the art that changes may be made in these embodiments without departing from the principles and spirit of the disclosure, the scope of which is defined in the claims and their equivalents.

The invention claimed is:

1. A refrigerator comprising:

a body provided with a storage compartment;

a door rotatable with respect to a hinge shaft on the body, the door being configured to open and close the storage compartment; and a door opening and closing apparatus configured to open and close the door, wherein the door opening and closing apparatus comprises:

a motor configured to generate power, a first gear rotated in conjunction with the power generated by the motor, a second gear configured to transmit a rotational force to the hinge shaft as the door opens and closes, and a pair of intermittent gears configured to transmit the power from the first gear to the second gear, the pair of intermittent gears being configured to prevent an external force from being transmitted from the second gear to the first gear while the external force is applied to open and close the door.

2. The refrigerator of claim 1, wherein the pair of intermittent gears comprises a first intermittent gear and a second intermittent gear rotated with respect to the same axis as the first intermittent gear, wherein the first intermittent gear is detachably coupled to the second intermittent gear in an axial direction.

3. The refrigerator of claim 2, wherein the first intermittent gear is moved between a coupling position in which the first intermittent gear is coupled to the second intermittent gear to transmit the power to the second intermittent gear, and a separated position in which the first intermittent gear is separated from the second intermittent gear.

4. The refrigerator of claim 3, further comprising:

an intermittent gear elastic member configured to generate an elastic restoring force toward the axial direction to resiliently return the first intermittent gear from the separated position to the coupling position.

5. The refrigerator of claim 2, wherein the second intermittent gear is operated depending on rotation of the second gear.

6. The refrigerator of claim 2, wherein the first intermittent gear and second intermittent gear comprise respective at least one first inclined boss portion and at least one second inclined boss portion formed on surfaces facing each other.

7. The refrigerator of claim 6, wherein the at least one first inclined boss portion and the at least one second inclined boss portion comprise a first inclined surface and a second inclined surface, respectively, the first inclined surface and the second incline surface configured to come into contact with each other to transmit the power from the first intermittent gear to the second intermittent gear, the first inclined surface and the second inclined surface being formed to be inclined in a circumferential direction with respect to a direction in which the first intermittent gear and the second intermittent gear face each other, wherein the first inclined surface and the second inclined surface are configured to generate a slip therebetween due to the external force.

8. The refrigerator of claim 6, wherein the at least one first inclined boss portion and the at least one second inclined boss portion are among a plurality of first and second inclined boss portions alternately disposed.

9. The refrigerator of claim 1, further comprising:

a third gear engaged with the first gear; and a pair of idle gears moved in a circumferential direction by a rotation of the third gear so as to selectively transmit a rotational force of the third gear to the pair of intermittent gears.

10. The refrigerator of claim 9, wherein the pair of idle gears are moved between:

a first position in which a first idle gear of the pair of idle gears is engaged with the pair of intermittent gears while the third gear is rotated in a first direction, a second position in which a second idle gear of the pair of idle gears is engaged with the pair of intermittent gears while the third gear is rotated in a second direction opposite to the first direction; and a third position in which a second idle gear of the pair of idle gears and the first idle gear are separated from the pair of intermittent gears.

11. The refrigerator of claim 10, further comprising:

a switching member provided with the pair of idle gears, the switching member being configured to allow the pair of idle gears to be moved from the first position to the third position, in conjunction with the third gear.

12. The refrigerator of claim 11, further comprising:

a pressure device configured to press the body to open the door, and a mounting member provided with a pressing protrusion configured to transmit power to the pressure device, and the mounting member being configured to be rotated with the third gear such that the switching member is disposed between the mounting member and the third gear, wherein the switching member is operated independently of the mounting member.

13. The refrigerator of claim 12, wherein the pressure device comprises a sliding member moved in a sliding manner by being pressed by the pressing protrusion; and a pressing member configured to be rotated by the sliding of the sliding member and configured to come into contact with the body to open the door.

14. The refrigerator of claim 12, wherein:

the pressure device comprises a delay member configured to allow an operation of the pressure device and an operation in which the pair of idle gears is placed in the first position, to be sequentially performed.

15. The refrigerator of claim 10, wherein in the first position, a forward rotational force of the motor is transmitted to open the door, and in the second position, a reverse rotational force of the motor is transmitted to close the door.

16. A refrigerator comprising:

a body provided with a storage compartment;

a door configured to be rotatable with respect to a hinge shaft disposed at the body, the door being configured to open and close the storage compartment; and a door opening and closing apparatus configured to open and close the door, wherein the door opening and closing apparatus comprises:

a motor configured to generate power;

a rotary gear restrained by the hinge shaft; and a driving gear configured to transmit the power generated from the motor to the rotary gear, wherein the driving gear comprises a pair of intermittent gears configured to detach from each other, to prevent a load from being applied in a direction opposite to a rotation direction of the motor, or greater than a rotational force of the motor, to the rotary gear.

17. The refrigerator of claim 16, wherein the pair of intermittent gears comprises a first intermittent gear and a second intermittent gear rotated with respect to the same axis as the first intermittent gear, wherein the first intermittent gear is detachably coupled to the second intermittent gear in an axial direction.

18. The refrigerator of claim 17, wherein the first intermittent gear is moved between a coupling position in which the first intermittent gear is coupled to the second intermittent gear to transmit the power to the second intermittent gear, and a separated position in which the first intermittent gear is separated from the second intermittent gear.

19. The refrigerator of claim 17, wherein:

the first intermittent gear and the second intermittent gear comprise respective at least one first inclined boss portion and at least one second inclined boss portion formed on surfaces facing each other.

20. A refrigerator comprising:

a body provided with a storage compartment;

a door configured to open and close the storage compartment; and a door opening and closing apparatus configured to open and close the door, wherein the door opening and closing apparatus comprises:

a motor configured to generate power;

a first gear rotated in conjunction with the power generated by the motor;

a second gear configured to transmit a rotational force to a hinge shaft of the door as the door opens and closes;

a third gear configured to engage with the first gear; and a pair of idle gears configured to selectively transmit the rotational force of the third gear to the second gear, through rotation of the third gear, wherein the second gear comprises:

a pair of intermittent gears configured to be moved between a coupling position to transfer the power from the motor to the hinge shaft, and a separated position to prevent a load from the hinge shaft to the motor.

* * * * *